US009799261B2

(12) United States Patent
Rotzoll

(10) Patent No.: US 9,799,261 B2
(45) Date of Patent: Oct. 24, 2017

(54) SELF-COMPENSATING CIRCUIT FOR FAULTY DISPLAY PIXELS

(71) Applicant: X-Celeprint Limited, Cork (IE)

(72) Inventor: Robert R. Rotzoll, Colorado Springs, CO (US)

(73) Assignee: X-Celeprint Limited, Lee Maltings, Dyke Parade, Cork (IE)

( * ) Notice: Subject to any disclaimer, the term of this patent is extended or adjusted under 35 U.S.C. 154(b) by 44 days.

(21) Appl. No.: 14/809,982

(22) Filed: Jul. 27, 2015

(65) Prior Publication Data

US 2016/0358533 A1 Dec. 8, 2016

Related U.S. Application Data

(60) Provisional application No. 62/170,589, filed on Jun. 3, 2015.

(51) Int. Cl.
*G09G 3/20* (2006.01)
*G09G 3/32* (2016.01)

(52) U.S. Cl.
CPC ..... *G09G 3/2092* (2013.01); *G09G 3/32* (2013.01); *G09G 2300/08* (2013.01); *G09G 2330/08* (2013.01)

(58) Field of Classification Search
CPC ..... G09G 3/30–3/3208; G09G 3/3225; G09G 3/3233; G09G 3/3258; G09G 2330/08–2330/10
See application file for complete search history.

(56) References Cited

U.S. PATENT DOCUMENTS

| | | | |
|---|---|---|---|
| 5,550,066 | A | 8/1996 | Tang et al. |
| 5,621,555 | A | 4/1997 | Park |
| 5,815,303 | A | 9/1998 | Berlin |
| 6,278,242 | B1 | 8/2001 | Cok et al. |
| 6,577,367 | B2 | 6/2003 | Kim |
| 6,717,560 | B2 | 4/2004 | Cok et al. |
| 6,756,576 | B1 | 6/2004 | McElroy et al. |
| 6,933,532 | B2 | 8/2005 | Arnold et al. |
| 7,012,382 | B2 | 3/2006 | Cheang et al. |
| 7,129,457 | B2 | 10/2006 | McElroy et al. |
| 7,195,733 | B2 | 3/2007 | Rogers et al. |
| 7,288,753 | B2 | 10/2007 | Cok |
| 7,521,292 | B2 | 4/2009 | Rogers et al. |

(Continued)

FOREIGN PATENT DOCUMENTS

| | | |
|---|---|---|
| WO | WO-2008/103931 A2 | 8/2008 |
| WO | WO-2014/149864 A1 | 9/2014 |

OTHER PUBLICATIONS

Roscher, H., VCSEL Arrays with Redundant Pixel Designs for 10Gbits/s 2-D Space-Parallel MMF Transmission, Annual Report, optoelectronics Department, (2005).

(Continued)

*Primary Examiner* — Liliana Cerullo
(74) *Attorney, Agent, or Firm* — William R. Haulbrook; Alexander D. Augst; Choate, Hall & Stewart LLP

(57) ABSTRACT

A self-compensating circuit for controlling pixels in a display includes a plurality of light-emitter circuits. Each light-emitter circuit includes a light emitter, a drive transistor, and a compensation circuit. The compensation circuit is connected to the light emitter of one or more different light-emitter circuits.

18 Claims, 16 Drawing Sheets

(56) References Cited

U.S. PATENT DOCUMENTS

| | | | |
|---|---|---|---|
| 7,557,367 | B2 | 7/2009 | Rogers et al. |
| 7,586,497 | B2 | 9/2009 | Boroson et al. |
| 7,622,367 | B1 | 11/2009 | Nuzzo et al. |
| 7,662,545 | B2 | 2/2010 | Nuzzo et al. |
| 7,704,684 | B2 | 4/2010 | Rogers et al. |
| 7,799,699 | B2 | 9/2010 | Nuzzo et al. |
| 7,816,856 | B2 | 10/2010 | Cok et al. |
| 7,893,612 | B2 | 2/2011 | Cok |
| 7,927,976 | B2 | 4/2011 | Menard |
| 7,932,123 | B2 | 4/2011 | Rogers et al. |
| 7,943,491 | B2 | 5/2011 | Nuzzo et al. |
| 7,972,875 | B2 | 7/2011 | Rogers et al. |
| 7,982,296 | B2 | 7/2011 | Nuzzo et al. |
| 7,999,454 | B2 | 8/2011 | Winters et al. |
| 8,029,139 | B2 | 10/2011 | Ellinger et al. |
| 8,039,847 | B2 | 10/2011 | Nuzzo et al. |
| 8,198,621 | B2 | 6/2012 | Rogers et al. |
| 8,207,547 | B2 | 6/2012 | Lin |
| 8,261,660 | B2 | 9/2012 | Menard |
| 8,334,545 | B2 | 12/2012 | Levermore et al. |
| 8,394,706 | B2 | 3/2013 | Nuzzo et al. |
| 8,440,546 | B2 | 5/2013 | Nuzzo et al. |
| 8,470,701 | B2 | 6/2013 | Rogers et al. |
| 8,502,192 | B2 | 8/2013 | Kwak et al. |
| 8,506,867 | B2 | 8/2013 | Menard |
| 8,664,699 | B2 | 3/2014 | Nuzzo et al. |
| 8,686,447 | B2 | 4/2014 | Tomoda et al. |
| 8,722,458 | B2 | 5/2014 | Rogers et al. |
| 8,754,396 | B2 | 6/2014 | Rogers et al. |
| 8,766,970 | B2 | 7/2014 | Chien et al. |
| 8,791,474 | B1 | 7/2014 | Bibl et al. |
| 8,794,501 | B2 | 8/2014 | Bibl et al. |
| 8,803,857 | B2 | 8/2014 | Cok |
| 8,817,369 | B2 | 8/2014 | Daiku |
| 8,854,294 | B2 | 10/2014 | Sakariya |
| 8,877,648 | B2 | 11/2014 | Bower et al. |
| 8,889,485 | B2 | 11/2014 | Bower |
| 8,895,406 | B2 | 11/2014 | Rogers et al. |
| 8,987,765 | B2 | 3/2015 | Bibl et al. |
| 9,468,050 | B1 | 10/2016 | Rotzoll et al. |
| 2002/0196213 | A1* | 12/2002 | Akimoto ..... G09G 3/3258 345/82 |
| 2004/0189213 | A1* | 9/2004 | Okazaki ..... H01L 27/3253 315/169.1 |
| 2004/0252089 | A1 | 12/2004 | Ono et al. |
| 2010/0248484 | A1 | 9/2010 | Bower et al. |
| 2011/0073860 | A1 | 3/2011 | Kanno et al. |
| 2012/0228669 | A1 | 9/2012 | Bower et al. |
| 2012/0314388 | A1 | 12/2012 | Bower et al. |
| 2013/0069275 | A1 | 3/2013 | Menard et al. |
| 2013/0088416 | A1 | 4/2013 | Smith et al. |
| 2013/0196474 | A1 | 8/2013 | Meitl et al. |
| 2013/0207964 | A1 | 8/2013 | Fleck et al. |
| 2013/0221355 | A1 | 8/2013 | Bower et al. |
| 2013/0273695 | A1 | 10/2013 | Menard et al. |
| 2014/0104243 | A1 | 4/2014 | Sakariya et al. |
| 2014/0264763 | A1 | 9/2014 | Meitl et al. |
| 2014/0267683 | A1 | 9/2014 | Bibl et al. |
| 2014/0367633 | A1 | 12/2014 | Bibl et al. |
| 2015/0103070 | A1* | 4/2015 | In ..... G09G 3/3233 345/214 |
| 2015/0135525 | A1 | 5/2015 | Bower |
| 2015/0137153 | A1 | 5/2015 | Bibl et al. |
| 2015/0243203 | A1* | 8/2015 | Kim ..... G09G 3/2092 345/212 |
| 2017/0025075 | A1 | 1/2017 | Cok et al. |

OTHER PUBLICATIONS

Yaniv et al., A 640×480 Pixel Computer Display Using Pin Diodes with Device Redundancy, 1988 International Display Research Conference, IEEE, CH-2678-1/88:152-154 (1988).

* cited by examiner

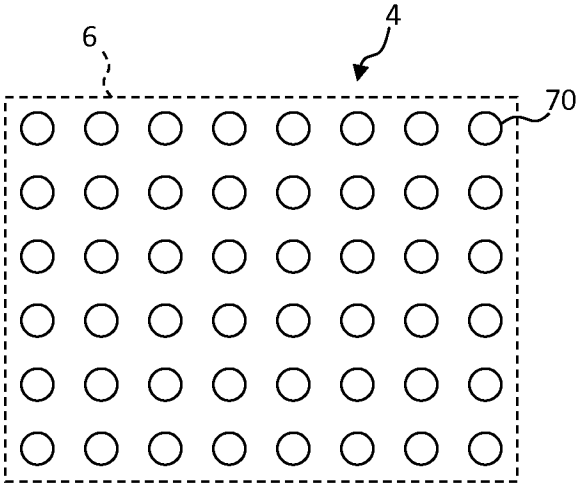
FIG. 6
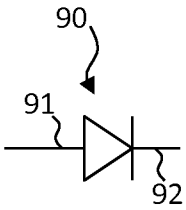
FIG. 5 – Prior Art

SELF-COMPENSATING CIRCUIT FOR FAULTY DISPLAY PIXELS

PRIORITY APPLICATION

This application claims priority to and the benefit of U.S. Provisional Patent Application No. 62/170,589, filed Jun. 3, 2015, entitled "Self-Compensating Circuit for Faulty Display Pixels," the contents of which is hereby incorporated by reference in its entirety.

CROSS REFERENCE TO RELATED APPLICATION

Reference is made to U.S. Provisional Patent Application No. 62/170,583, filed Jun. 3, 2015, entitled "Self-Compensating Circuit for Faulty Display Pixels," U.S. patent application Ser. No. 14/495,830, filed Jul. 9, 2015, entitled "Self-Compensating Circuit for Faulty Display Pixels," U.S. Patent Application Ser. No. 62/055,472 filed Sep. 25, 2014, entitled "Compound Micro-Assembly Strategies and Devices", and U.S. patent application Ser. No. 14/743,981, filed Jun. 18, 2015, entitled "Micro-Assembled Micro LED Displays and Lighting Elements," the contents of which are hereby incorporated by reference in their entirety.

FIELD OF THE INVENTION

The present invention relates to a control circuit for providing fault tolerance to pixels in a display.

BACKGROUND OF THE INVENTION

Flat-panel displays are widely used in computing devices, in portable devices, and for entertainment devices such as televisions. Such displays typically employ a plurality of pixels distributed in an array over a display substrate to display images, graphics, or text. For example, liquid-crystal displays (LCDs) employ liquid crystals to block or transmit light from a backlight behind the liquid crystals. Organic light-emitting diode (OLED) displays rely on passing current through a layer of organic material that glows in response to the electrical current. Each pixel usually includes three or more sub-pixels emitting light of different colors, for example red, green, and blue.

Displays are typically controlled with either a passive-matrix (PM) control employing electronic circuitry external to the display substrate or an active-matrix (AM) control employing electronic circuitry formed directly on the display substrate and associated with each light-emitting element. Both OLED displays and LCDs using passive-matrix control and active-matrix control are available. An example of such an AM OLED display device is disclosed in U.S. Pat. No. 5,550,066.

Typically, each display sub-pixel is controlled by one control element, and each control element includes at least one transistor. For example, in a simple active-matrix OLED display, each control element includes two transistors (a select transistor and a drive transistor) and one capacitor for storing a charge specifying the desired luminance of the sub-pixel. Each OLED element employs an independent control electrode connected to the power transistor and a common electrode. In contrast, an LCD typically uses a single-transistor circuit. Control of the light-emitting elements is usually provided through a data signal line, a select signal line, a power connection and a ground connection. Active-matrix elements are not necessarily limited to displays and can be distributed over a substrate and employed in other applications requiring spatially distributed control.

Active-matrix circuitry is commonly achieved by forming thin-film transistors (TFTs) in a semiconductor layer formed on a display substrate and employing a separate TFT circuit to control each light-emitting pixel in the display. The semiconductor layer is typically amorphous silicon or polycrystalline silicon and is distributed over the entire flat-panel display substrate. The semiconductor layer is photolithographically processed to form electronic control elements, such as transistors and capacitors, Additional layers, for example insulating dielectric layers and conductive metal layers are provided, often by evaporation or sputtering, and photolithographically patterned to form electrical interconnections, structures, or wires.

In any display device it is important that light is uniformly displayed from the pixels arranged over the extent of the display when correspondingly controlled by a display controller to avoid visible non-uniformities or irregularities in the display. As display size and resolution increase, it becomes more difficult to manufacture displays without any pixel defects and therefore manufacturing yields decrease and costs increase. To increase yields, fault-tolerant designs are sometimes incorporated into the displays, particularly in the circuitry used to control the pixels in the display or by providing additional redundant pixels or sub-pixels.

Numerous schemes have been suggested to provide pixel fault tolerance in displays. For example, U.S. Pat. No. 5,621,555 describes an LCD with redundant pixel electrodes and thin-film transistors and U.S. Pat. No. 6,577,367 discloses a display with extra rows or columns of pixels that are used in place of defective or missing pixels in a row or column. U.S. Pat. No. 8,766,970 teaches a display pixel circuit with control signals to determine and select one of two emitters at each sub-pixel site on the display substrate.

Furthermore, in flat-panel displays using thin-film transistors formed in an amorphous or polysilicon layer on a substrate, the additional circuitry required to support complex control schemes can further reduce the aperture ratio or be difficult or impossible to implement for a particular display design.

There remains a need, therefore, for a design and manufacturing method that enables fault tolerance in a display without compromising the aperture ratio of the display or limiting display design options.

SUMMARY OF THE INVENTION

The present invention provides a self-compensating circuit for controlling pixels in a display. In an embodiment, the self-compensating circuit and pixels are formed on a substrate, for example in a thin film of semiconductor material. In another embodiment, the pixels include inorganic light emitters that are micro transfer printed onto a display substrate as well as controllers incorporating the self-compensating control circuit. Alternatively, the light emitters or controllers are micro-transfer printed onto a pixel substrate separate and independent from the display substrate. The pixel substrates are then located on the display substrate and electrically interconnected, for example using conventional photolithography. Because the inorganic light emitters are relatively small compared to other light-controlling elements such as liquid crystals or OLEDs, a more complex, self-compensating control circuit does not decrease the aperture ratio of the display.

According to embodiments of the present invention, a self-compensating circuit compensates for a missing or defective light emitter by increasing the current supplied to other light emitters, for example light emitters that are spatially adjacent on a substrate. The increased current supplied to the other spatially adjacent light emitters causes an increase in light output by the other emitters, so that the overall light output is the same as if all of the light emitters are functioning. When all of the light emitters are working properly, each circuit independently supplies current to the light emitters according to a control drive signal. When one or more of the light emitters are not present or fail, the self-compensating control circuit for each faulty light emitter supplies current to the other light emitters in the self-compensating circuit according to the control drive signal of the faulty light emitter. This provides fault tolerance for missing or defective pixels without requiring external detection or control of the defective pixels. If the pixels are arranged over the substrate with a sufficiently high resolution, the compensated light output is not readily noticed by an observer.

The disclosed technology, in certain embodiments, provides a self-compensating circuit for controlling pixels in a display having fault tolerance for missing or defective pixels without requiring external detection or control of the defective pixels. In an embodiment, the self-compensating circuit does not decrease the aperture ratio of the display.

In one aspect, the disclosed technology includes a self-compensating circuit for controlling pixels in a display, the self-compensating circuit including: a plurality of light-emitter circuits, each light-emitter circuit including: a light emitter having a power connection to a power supply and an emitter connection; a drive transistor having a gate connected to a drive signal, a drain connected to the emitter connection, and a source connected to a ground; and a compensation circuit comprising one or more compensation diodes, each compensation diode connected to the emitter connection and connected to an other emitter connection of one or more light-emitter circuits other than the light-emitter circuit of which the compensation diode is a part, thereby emitting compensatory light from the one or more light-emitter circuits when the light emitter is faulty.

In certain embodiments, the light emitters are inorganic light-emitters.

In certain embodiments, the inorganic light emitters are inorganic light-emitting diodes.

In certain embodiments, the size of the compensation diodes in a light-emitter circuit is inversely related to the number of compensation diodes in the light-emitter circuit.

In certain embodiments, the number of compensation diodes in each light-emitter circuit is one fewer than the number of light emitters in the self-compensating circuit.

In certain embodiments, each compensation circuit of the plurality of light-emitter circuits has one compensation diode and the compensation diode is electrically connected in common to a common compensation connection and wherein each compensation circuit further includes a transfer diode connected to the emitter connection and to the common compensation connection with a polarity that is the reverse of the compensation diode polarity.

In certain embodiments, the light emitter is a light-emitting diode with a width from 2 to 5 μm, 5 to 10 μm, 10 to 20 μm, or 20 to 50 μm.

In certain embodiments, the light emitter is a light-emitting diode with a length from 2 to 5 μm, 5 to 10 μm, 10 to 20 μm, or 20 to 50 μm.

In certain embodiments, the light emitter is a light-emitting diode with a height from 2 to 5 μm, 4 to 10 μm, 10 to 20 μm, or 20 to 50 μm.

In another aspect, the disclosed technology includes a self-compensating display, the display including an array of light emitters forming rows and columns of light emitters on a display substrate, each light emitter controlled by a self-compensating circuit as described herein.

In certain embodiments, the display substrate is a polymer, plastic, resin, polyimide, PEN, PET, metal, metal foil, glass, a semiconductor, or sapphire.

In certain embodiments, the light emitters are arranged in exclusive groups of adjacent light emitters so that each light emitter is a member of only one group and wherein each compensation diode in a light-emitter circuit of a light emitter is connected to a different one of the emitter connections in the light-emitter circuits of the other light emitters in the exclusive group.

In certain embodiments, the number of compensation diodes in each light-emitter circuit is equal to one less than the number of light emitters in the exclusive group.

In certain embodiments, each group of adjacent light emitters comprises two light emitters located in adjacent rows.

In certain embodiments, each group of adjacent light emitters comprises two light emitters located in adjacent columns.

In certain embodiments, each group of adjacent light emitters comprises four light emitters located in a two by two array forming two rows and two columns.

In certain embodiments, each group of adjacent light emitters is located on a pixel substrate that is independent and separate from the display substrate and the pixel substrates are mounted on the display substrate.

In certain embodiments, each light emitter is located on a pixel substrate that is independent and separate from the display substrate and the pixel substrates are mounted on the display substrate.

In certain embodiments, the light emitters are arranged in groups of adjacent light emitters and wherein each compensation diode in each light-emitter circuit is connected to a different one of the emitter connections in the light-emitter circuits of each light emitter in the group.

In certain embodiments, at least one group of light emitters overlaps another group of light emitters so that at least one light emitter is a member of more than one group.

In certain embodiments, each group of adjacent light emitters comprises five light emitters, the five light emitters arranged with a central light emitter having a left light emitter to the left of the central light emitter, a right light emitter to the right of the central light emitter, an upper light emitter above the central light emitter, and a lower light emitter below the central light emitter.

In certain embodiments, each group of adjacent light emitters comprises nine light emitters, the nine light emitters arranged with a central light emitter having a light emitter above the central light emitter, a light emitter below the central light emitter, a light emitter on the left side of the central light emitter, a light emitter on the right side of the central light emitter, a light emitter on the upper left of the central light emitter, a light emitter on the upper right of the central light emitter, a light emitter on the lower left of the central light emitter, and a light emitter on the lower right of the central light emitter.

In another aspect, the disclosed technology includes a self-compensating circuit for controlling pixels in a display, the self-compensating circuit including: a plurality of light-emitter circuits, each light-emitter circuit including: a light emitter having a power connection to a power supply and an emitter connection; a drive transistor having a gate connected to a drive signal, a drain connected to the emitter connection, and a source connected to a ground; and one or more compensation diodes, each compensation diode connected to the emitter connection of the light-emitter circuit of which the one or more compensation diodes are a part, wherein the number of compensation diodes in each light-emitter circuit is one fewer than the number of light emitters in the self-compensating circuit and each compensation diode in each light-emitter circuit is connected to an other emitter connection of each of one or more light-emitter circuits other than the light-emitter circuit of which the compensation diode is a part, thereby emitting compensatory light from the one or more light-emitter circuits when the light emitter is faulty.

In certain embodiments, the light emitters are inorganic light-emitters.

In certain embodiments, the inorganic light emitters are inorganic light-emitting diodes.

In certain embodiments, the compensation diodes in a light-emitter circuit have a size equal to or smaller than the drive transistor.

In certain embodiments, the size of the compensation diodes in a light-emitter circuit is inversely related to the number of compensation diodes in the light-emitter circuit.

In certain embodiments, the size of the compensation diodes in a light-emitter circuit is less than or equal to the size of the drive transistor divided by the number of compensation diodes.

In certain embodiments, the light emitter is a light-emitting diode with a width from 2 to 5 μm, 5 to 10 μm, 10 to 20 μm, or 20 to 50 μm.

In certain embodiments, the light emitter is a light-emitting diode with a length from 2 to 5 μm, 5 to 10 μm, 10 to 20 μm, or 20 to 50 μm.

In certain embodiments, the light emitter is a light-emitting diode with a height from 2 to 5 μm, 4 to 10 μm, 10 to 20 μm, or 20 to 50 μm.

In another aspect, the disclosed technology includes a self-compensating display, including an array of light emitters forming rows and columns on a display substrate, each light emitter controlled by a self-compensating circuit as described herein.

In certain embodiments, the display substrate is a polymer, plastic, resin, polyimide, PEN, PET, metal, metal foil, glass, a semiconductor, or sapphire.

In certain embodiments, the light emitters are arranged in exclusive groups of adjacent light emitters so that each light emitter is a member of only one group and wherein the each compensation diode in a light-emitter circuit is connected to a different one of the other emitter connections in the light-emitter circuits of the other light emitters in the exclusive group.

In certain embodiments, the number of compensation diodes in each light-emitter circuit is equal to one less than the number of light emitters in the exclusive group.

In certain embodiments, each group of adjacent light emitters comprises two light emitters located in adjacent rows.

In certain embodiments, each group of adjacent light emitters comprises two light emitters located in adjacent columns.

In certain embodiments, each group of adjacent light emitters comprises four light emitters located in a two by two array forming two rows and two columns.

In certain embodiments, each group of adjacent light emitters is located on a pixel substrate that is independent and separate from the display substrate and the pixel substrates are mounted on the display substrate.

In certain embodiments, each light emitter is located on a pixel substrate that is independent and separate from the display substrate and the pixel substrates are mounted on the display substrate.

In certain embodiments, the light emitters are arranged in groups of adjacent light emitters and wherein each compensation diode in each light-emitter circuit is connected to a different one of the emitter connections in the light-emitter circuits of each light emitter in the group.

In certain embodiments, at least one group of light emitters overlaps another group of light emitters so that at least one light emitter is a member of more than one group.

In certain embodiments, each group of adjacent light emitters comprises five light emitters, the five light emitters arranged with a central light emitters having a left light emitters to the left of the central light emitters, a right light emitters to the right of the central light emitters, an upper light emitters above the central light emitters, and a lower light emitters below the central light emitters.

In certain embodiments, each group of adjacent pixels comprises nine light emitters, the nine light emitters arranged with a central light emitter having a light emitter above the central light emitter, a light emitter below the central light emitter, a light emitter on the left side of the central light emitter, a light emitter on the right side of the central light emitter, a light emitter on the upper left of the central light emitter, a light emitter on the upper right of the central light emitter, a light emitter on the lower left of the central light emitter, and a light emitter on the lower right of the central light emitter.

In another aspect, the disclosed technology includes a self-compensating circuit for controlling pixels in a display, the circuit including: a plurality of light-emitter circuits, each light-emitter circuit including: a light emitter having a power connection to a power supply and an emitter connection; a drive transistor having a gate connected to a drive signal, a drain connected to the emitter connection, and a source connected to a ground; a compensation diode connected to the emitter connection and connected to a common compensation connection; and a transfer diode connected to the emitter connection and connected to the common compensation connection with a polarity that is the reverse of the compensation diode polarity, wherein the common compensation connection of each of the plurality of light-emitter circuits is electrically connected in common.

In certain embodiments, the light emitters are inorganic light-emitters.

In certain embodiments, the inorganic light emitters are inorganic light-emitting diodes.

In certain embodiments, the compensation diodes in a light-emitter circuit have a size equal to or smaller than the drive transistor.

In certain embodiments, the size of the compensation diodes in a light-emitter circuit is inversely related to the number of compensation diodes in the light-emitter circuit.

In certain embodiments, the size of the compensation diodes in a light-emitter circuit is less than or equal to the size of the drive transistor divided by the number of compensation diodes.

In certain embodiments, the light emitter is a light-emitting diode with a width from 2 to 5 μm, 5 to 10 μm, 10 to 20 μm, or 20 to 50 μm.

In certain embodiments, the light emitter is a light-emitting diode with a length from 2 to 5 μm, 5 to 10 μm, 10 to 20 μm, or 20 to 50 μm.

In certain embodiments, the light emitter is a light-emitting diode with a height from 2 to 5 μm, 4 to 10 μm, 10 to 20 μm, or 20 to 50 μm.

In another aspect, the disclosed technology includes a self-compensating display, including an array of light emitters forming rows and columns on a display substrate, each light emitter controlled by a self-compensating circuit as described herein.

In certain embodiments, the display substrate is a polymer, plastic, resin, polyimide, PEN, PET, metal, metal foil, glass, a semiconductor, or sapphire.

In certain embodiments, the light emitters are arranged in exclusive groups of adjacent light emitters so that each light emitter is a member of only one group and wherein the each compensation diode in a light-emitter circuit is connected to a different one of the other emitter connections in the light-emitter circuits of the other light emitters in the exclusive group.

In certain embodiments, the number of compensation diodes in each light-emitter circuit is equal to one less than the number of light emitters in the exclusive group.

In certain embodiments, each group of adjacent light emitters comprises two light emitters located in adjacent rows.

In certain embodiments, each group of adjacent light emitters comprises two light emitters located in adjacent columns.

In certain embodiments, each group of adjacent light emitters comprises four light emitters located in a two by two array forming two rows and two columns.

In certain embodiments, each group of adjacent light emitters is located on a pixel substrate that is independent and separate from the display substrate and the pixel substrates are mounted on the display substrate.

In certain embodiments, each light emitter is located on a pixel substrate that is independent and separate from the display substrate and the pixel substrates are mounted on the display substrate.

In certain embodiments, the light emitters are arranged in groups of adjacent light emitters and wherein each compensation diode in each light-emitter circuit is connected to a different one of the emitter connections in the light-emitter circuits of each light emitter in the group.

In certain embodiments, at least one group of light emitters overlaps another group of light emitters so that at least one light emitter is a member of more than one group.

In certain embodiments, each group of adjacent light emitters comprises five light emitters, the five light emitters arranged with a central light emitters having a left light emitters to the left of the central light emitters, a right light emitters to the right of the central light emitters, an upper light emitters above the central light emitters, and a lower light emitters below the central light emitters.

In certain embodiments, each group of adjacent pixels comprises nine light emitters, the nine light emitters arranged with a central light emitter having a light emitter above the central light emitter, a light emitter below the central light emitter, a light emitter on the left side of the central light emitter, a light emitter on the right side of the central light emitter, a light emitter on the upper left of the central light emitter, a light emitter on the upper right of the central light emitter, a light emitter on the lower left of the central light emitter, and a light emitter on the lower right of the central light emitter.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which:

FIG. 5 is a prior-art illustration of a diode useful in understanding the present invention;

FIG. 6 is an illustration of a display having pixels arranged in accordance with embodiments of the present invention;

Figure 1:
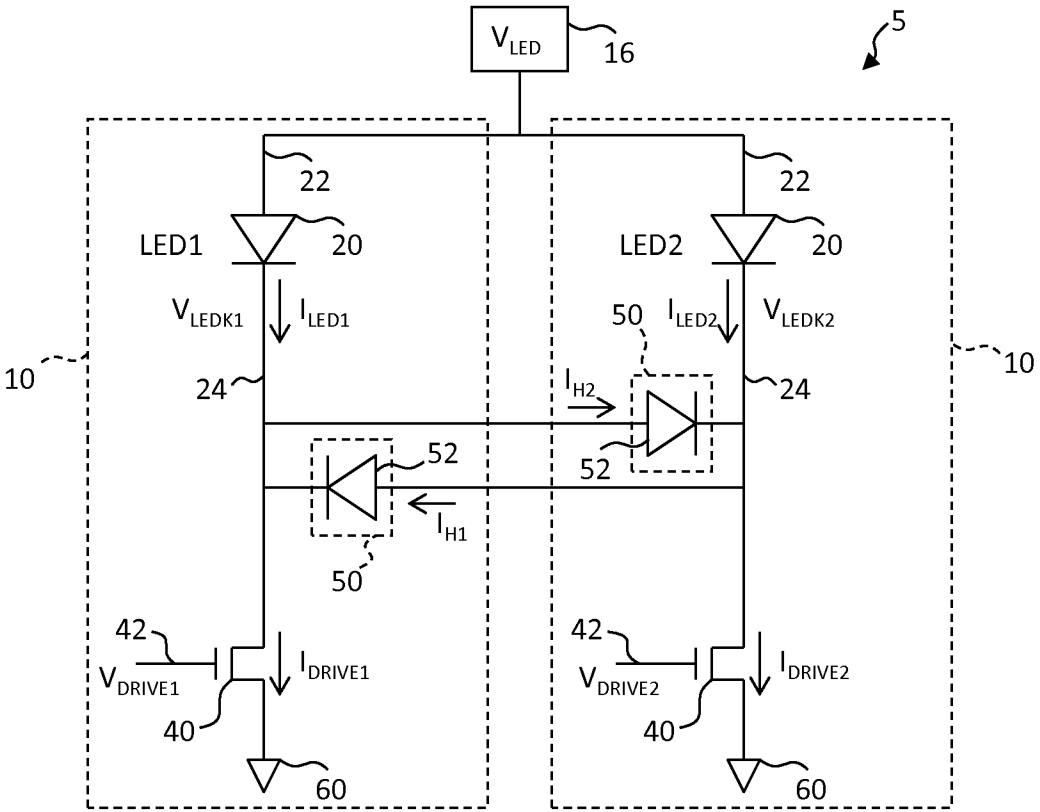
FIG. 1 is a schematic illustration of an embodiment of the present invention including two light-emitter circuits.
Figure 2:
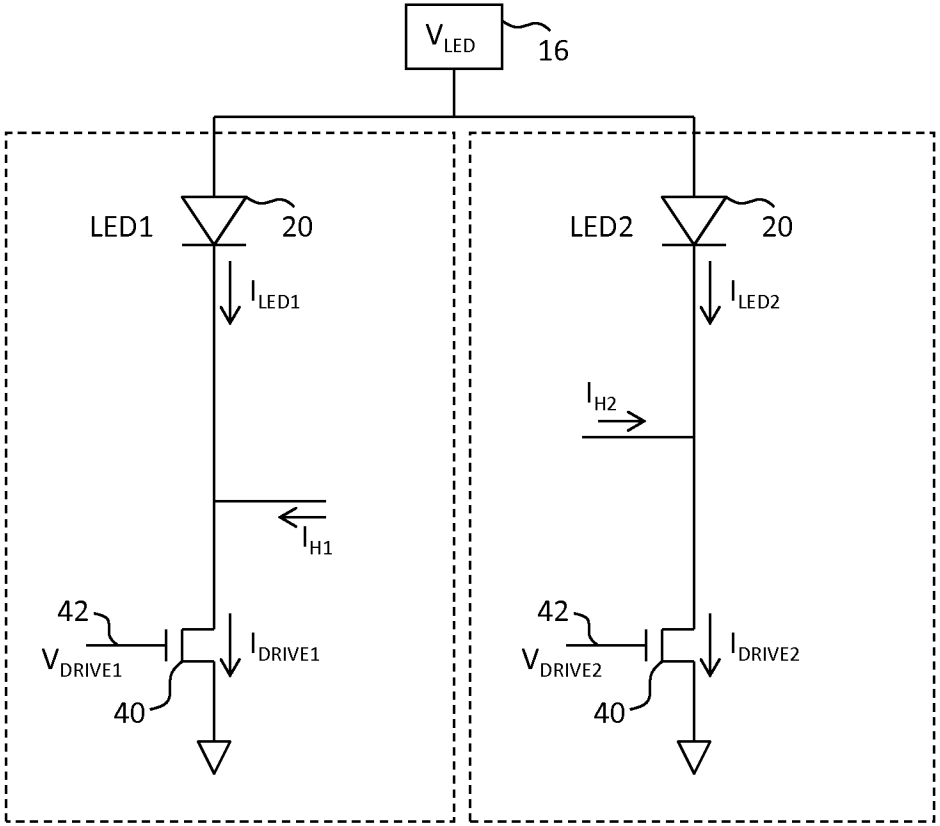
FIG. 2 is an equivalent circuit schematic illustration of the FIG. 1 circuit in a non-compensation mode.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The figures are not drawn to scale since the variation in size of various elements in the Figures is too great to permit depiction to scale.

DETAILED DESCRIPTION OF THE INVENTION

Figure 4:
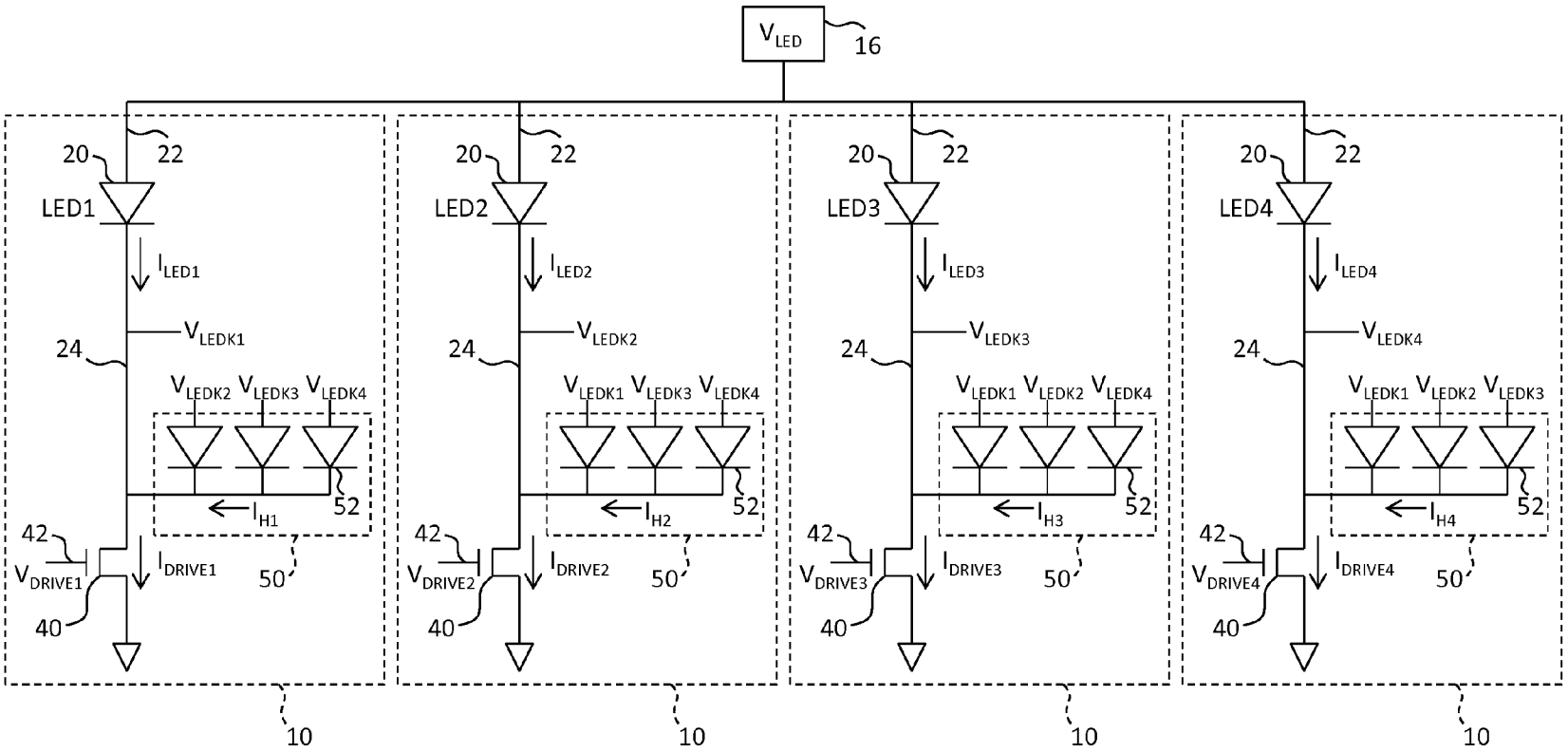
FIG. 4 is a schematic illustration of an embodiment of the present invention including four light-emitter circuits.

FIG. 1 is a schematic circuit diagram illustrating an embodiment of the present invention having two light emitters 20 in a self-compensating circuit 5 of the present invention. FIG. 4 is a schematic representation of an embodiment of the present invention having four light emitters 20 in the self-compensating circuit 5 of the present invention. The light emitters 20 are light-emitting elements in a self-compensating display 4 having an array of pixels 70, for example as shown in FIG. 6. Each of the light emitters 20 in FIGS. 1 and 4 corresponds to a pixel 70 or a sub-pixel of the self-compensating display 4. As used herein, a light emitter 20 can be a pixel or a light-emitting element of a pixel, for example a sub-pixel.

Referring to the embodiment of both FIGS. 1 and 4, the self-compensating circuit 5 for controlling pixels 70 in a display includes a plurality of light-emitter circuits 10. Each light-emitter circuit 10 includes a light emitter 20 having a power connection 22 to a power supply 16 and an emitter connection 24. The light emitter 20 can be a light-emitting diode and the power and emitter connections 22, 24 are the electrical connections to the light emitter 20 and are appropriately connected to permit current to flow through the light emitter 20 to emit light from the light emitter 20 when a suitable voltage is applied across the power and emitter connections 22, 24. The electrical connections as described herein can be, for example, metal wires, sintered metal particles, metal oxides, or other materials that conduct electricity.

A drive transistor 40 has a gate connected to a drive signal 42, a drain connected to the emitter connection 24, and a source connected to a ground 60. Transistors are very well known and all variants of transistors may be used in the circuits, such as metal-oxide field effect transistors (MOSFETs), bipolar junction transistors (BJTs), junction field-effect transistors (JFETs), and others. Referring briefly to prior-art FIG. 5, a diode 90 includes an anode 91 and a cathode 92. The voltage applied between the anode 91 and cathode 92 controls the flow of current from the anode 91 to the cathode 92 through the diode 90. If the anode 91 voltage is higher than the voltage at the cathode 92 by an amount defined as the diode turn-on voltage, the diode will conduct current. If the anode 91 voltage is lower than the voltage at the cathode 92, the diode will not conduct current. Diodes 90 useful in the present invention can be made in crystalline semiconductors such as silicon or in thin films of amorphous or polysilicon coated on a substrate such as a display substrate.

Each light-emitter circuit 10 includes a compensation circuit 50 that has one or more compensation diodes 52, each compensation diode 52 connected to the emitter connection 24 and connected to the emitter connection of a light-emitter circuit 10 other than the light-emitter circuit 10 of which the compensation diode 52 is a part. In different embodiments of the present invention, different compensation circuits 50 include different numbers of compensation diodes 52. In the embodiment of FIGS. 1 and 4, the number of compensation diodes 52 in each light-emitter circuit 10 is one fewer than the number of light emitters 20 in the self-compensating circuit 5. The example of FIG. 1 has two light emitters 20 and therefore only one compensation diode 52 in each light-emitter circuit 10 of the self-compensating circuit 5. The example of FIG. 4 has four light emitters 20 and therefore only three compensation diodes 52 in each light-emitter circuit 10 of the self-compensating circuit 5.

In an embodiment of the present invention, the light emitters 20 are inorganic light-emitters such as inorganic light-emitting diodes.

In FIG. 1, the light emitters 20 are labeled "LED1" and "LED2," respectively. Thus, the compensation diode 52 in the light-emitter circuit 10 corresponding to LED1 is connected to the emitter connection 24 of the light-emitter circuit 10 corresponding to LED2. Similarly, the compensation diode 52 in the light-emitter circuit 10 corresponding to LED2 is connected to the emitter connection 24 of the light-emitter circuit 10 corresponding to LED1. The light-emitter circuit 10 including LED1 is a different light-emitter circuit 10 from and is another light-emitter circuit 10 than the light-emitter circuit 10 that includes LED2.

In FIG. 4, the light emitters 20 are labeled "LED1," "LED2," "LED3," and "LED4," respectively. As noted above, there are therefore three compensation diodes 52 in each light-emitter circuit 10. (For clarity, in FIG. 4 the wiring for the emitter connections 24 to the compensation diodes 52 in the light-emitter circuits 10 is not shown.) Each compensation diode 52 is directly connected to a different emitter connection 24 in another light-emitter circuit 10. Thus, the compensation diodes 52 of the light-emitter circuit 10 including LED1 are connected to the emitter connections 24 of the light-emitter circuits 10 including LED2, LED3, and LED4, respectively. The compensation diodes 52 of the light-emitter circuit 10 including LED2 are connected to the emitter connections 24 of the light-emitter circuits 10 including LED1, LED3, and LED4, respectively. The compensation diodes 52 of the light-emitter circuit 10 including LED3 are connected to the emitter connections 24 of the light-emitter circuits 10 including LED1, LED2, and LED4, respectively. The compensation diodes 52 of the light-emitter circuit 10 including LED4 are connected to the emitter connections 24 of the light-emitter circuits 10 including LED1, LED2, and LED3, respectively. For clarity, in the circuit FIGS. 1-4, the emitter connection 24 of the light-emitter circuit 10 including LED1 is labeled $V_{LEDK1}$, the emitter connection 24 of the light-emitter circuit 10 including LED2 is labeled $V_{LEDK2}$, the emitter connection 24 of the light-emitter circuit 10 including LED3 is labeled $V_{LEDK3}$, and the emitter connection 24 of the light-emitter circuit 10 including LED4 is labeled $V_{LEDK4}$. The "LEDK" nomenclature refers to the voltage of the LED cathode. Similarly, the drive signals 42 of each of the light-emitter circuits 10 are labeled $V_{DRIVE}$ with a suffix corresponding to the LED of the light-emitter circuit 10 of which it is a part. Other elements of the light-emitter circuits 10 are similarly labeled with suffixes corresponding to the LED of the light-emitter circuit 10 of which they are a part.

In operation, the compensation diodes 52 of each light-emitter circuit 10 act as switches that operate in response to current flowing through the LED of the light-emitter circuit 10. When no fault is present, the compensation diodes 52 of the same light-emitter circuit 10 are effectively in an OFF state and current $I_{LED}$ flows through the corresponding LED. In this case, current $I_H$ is zero and current $I_{DRIVE}$ is equal to current $I_{LED}$. Referring to the equivalent circuit corresponding to the OFF state illustrated in FIG. 2, the compensation diode 52 turns off so that each of the light-emitter circuits 10 acts independently to control current $I_{LED}$ from the power supply 16 to flow through each LED light emitter 20 in response to the $V_{DRIVE}$ drive signal 42 controlling the drive transistor 40.

Figure 3:
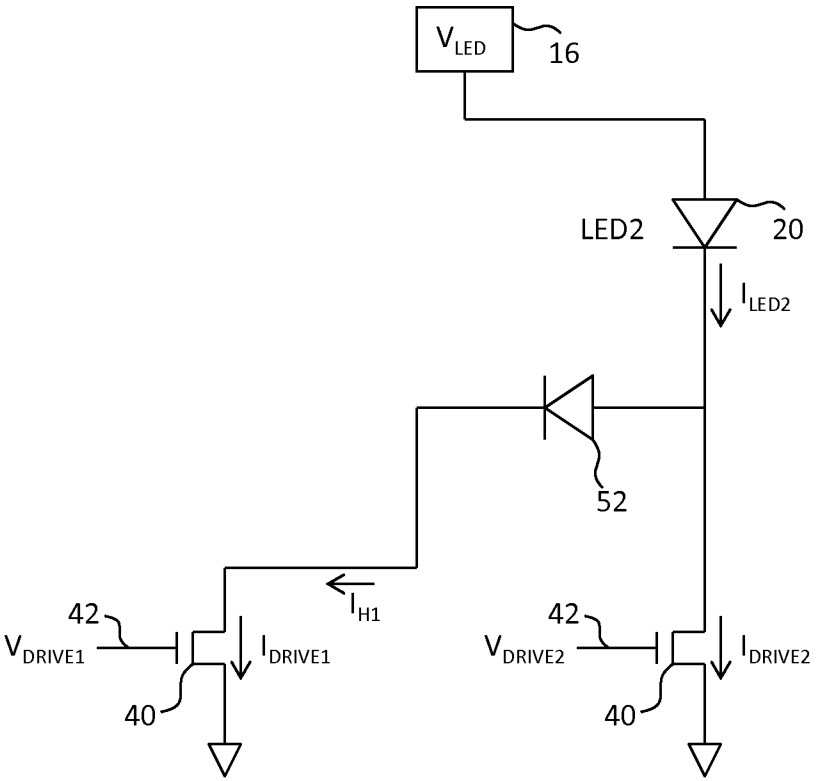
FIG. 3 is an equivalent circuit schematic illustration of the FIG. 1 circuit in a compensation mode.

In the case of a fault, for example corresponding to a case in which an LED is missing or defective, the compensation diodes 52 of the same light-emitter circuit 10 as the faulty LED are effectively in an ON state. FIG. 3 illustrates the equivalent circuit corresponding to the ON state of the compensation diode 52 when LED1 is missing or defective. As shown in FIG. 3, the compensation diode 52 turns on to pass current $I_{LED2}$ from the power supply 16 through LED2 corresponding to the sum of the drive currents $I_{DRIVE1}$ and $I_{DRIVE2}$ controlled by the $V_{DRIVE1}$ and $V_{DRIVE2}$ drive signals 42. In this case, current $I_{DRIVE1}$ is equal to current $I_{HI}$ and current $I_{LED2}$ is equal to $I_{DRIVE1}$ plus $I_{DRIVE2}$. Thus, LED2 will emit more light, compensating for the lack of light output by defective light emitter 20 LED1.

The four-light-emitter self-compensating circuit 5 of FIG. 4 operates in the same fashion as the two-light-emitter self-compensating circuit 5 of FIG. 1. If there is no fault, the compensation diodes 52 are in an OFF state, current flows through the light-emitters 20 normally, current $I_{DRIVE}$ is equal to current $I_{LED}$ and current $I_H$ equals zero, and the drive transistors 40 of the light-emitter circuits 10 effectively act independently to control the light output by light-emitters 20 in each light-emitter circuit 10 in response to the $V_{DRIVE}$ drive signals 42.

If a fault is present in a light-emitter circuit 10, the compensation diodes 52 in the faulty light-emitter circuit 10 will turn on and current will flow from each of the other light-emitter circuits 10 through the drive transistor 40 of that light-emitter circuit 10 corresponding to the $V_{DRIVE}$ drive signal 42. In the faulty light-emitter circuit 10, current $I_{LED}$ is zero and current $I_{DRIVE}$ is equal to current $I_H$. The $I_H$ current is shared among the compensation diodes 52 in the faulty light-emitter circuit 10 and is derived from the emitter connections 24 of the good light-emitter circuits 10. This will have the effect of increasing the $I_{LED}$ current through each of the LEDs in the other light-emitter circuits 10, so that each of the other LEDs emit more light to compensate for the light missing from the faulty LED.

This self-compensating circuit 5 will continue to work even if two or more light-emitter circuits 10 have faulty light emitters 20 as long as at least one light-emitting circuit 10 is functional. The drive transistors 40 of each of the light-emitter circuits 10 having faulty light emitters 20 will continue to pull current $I_{DRIVE}$ corresponding to their $V_{DRIVE}$ drive signals 42. This will increase the current $I_{LED}$ through the functioning light emitters 20 and increase their brightness to compensate for the faulty light emitters 20.

When the LED of a light-emitter circuit 10 is operating normally throughout its entire operating range, the compensation diodes 52 are turned off. When the LED of a light-emitter circuit 10 is missing or defective, the compensation diodes 52 turn on to provide a compensating current flow through the LEDs of the other light-emitter circuits 10. The compensation diodes 52 are switched from the ON state to the OFF state or vice versa by the emitter connection 24 voltage. When the LED of a light-emitter circuit 10 is operating normally throughout its entire operating range, the emitter voltage is pulled high (less the voltage drop across the LED). The compensation diode 52 then has a high and nearly equal voltage at both diode connections, so no current flows. If the LED is missing or has a large resistance (e.g. millions or billions of ohms), the drive transistor 40 associated with the faulty LED will pull the emitter connection low. The compensation diode 52 will therefore have an operating voltage supplied across its connections that turns the compensation diode 52 on and supplies from the operating light-emitter circuit 10 to the drive transistor 40 of the faulty light-emitter circuit 10.

An embodiment of the present invention was simulated to demonstrate its performance. In this simulation, a resistor Rled was placed in series with the LED2 light emitter 20 and the resistance of the resistor varied from 100Ω to 10 GΩ to simulate the effect of a functioning light emitter 20 at low resistance and a missing or defective light emitter 20 at high resistance. An additional light-emitter circuit 10 was added to the circuit of FIG. 1, in which an LED3 and associated diodes 52 were added between the emitter connection 24 of LED3 and the emitter connection 24 of LED2.

Figure 17:
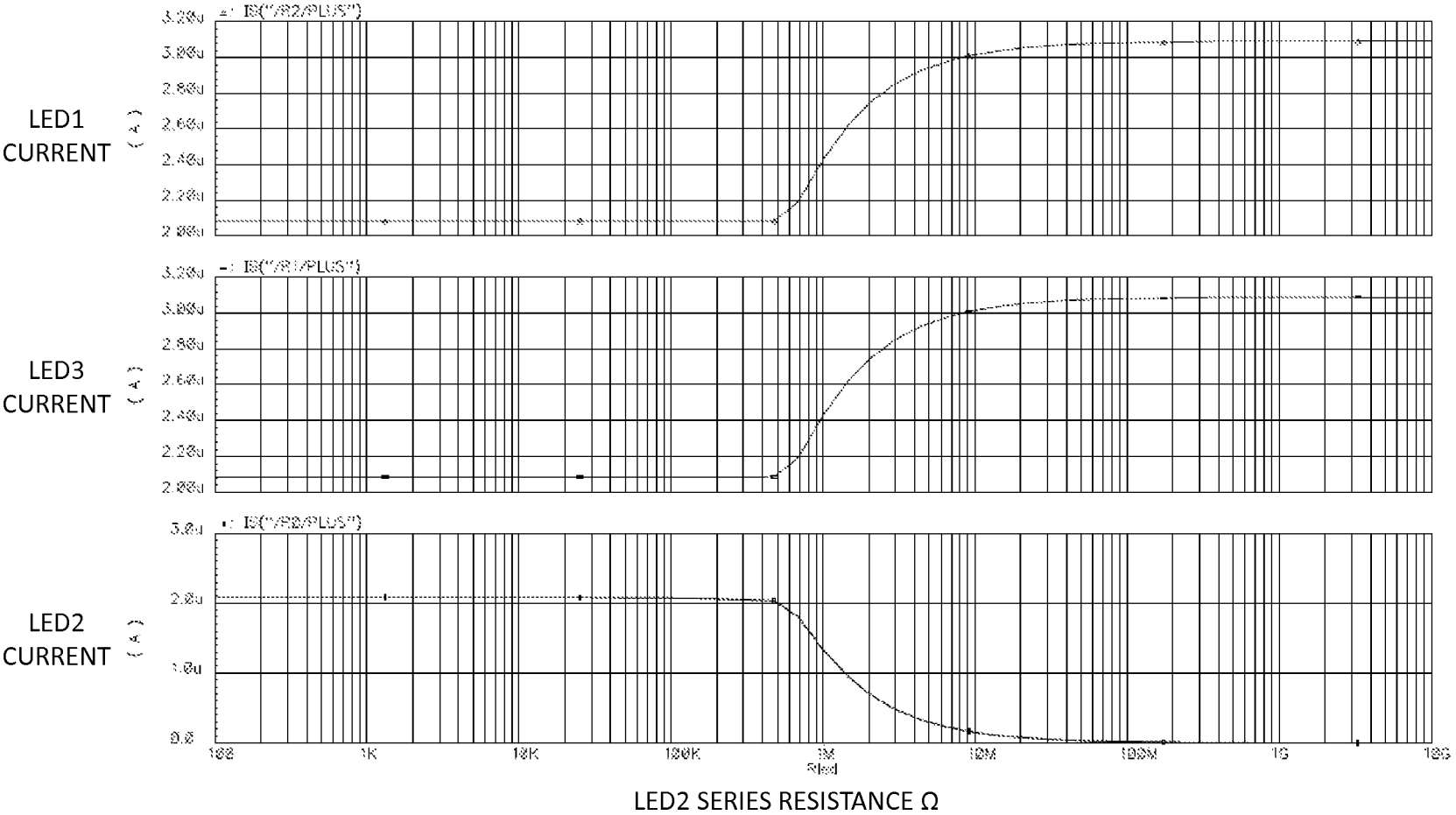
FIG. 17 is a graph illustrating the performance of an embodiment of the present invention.

FIG. 17 illustrates the simulated performance of the circuit having three light-emitting circuits 10. In this simulation, the $V_{DRIVE2}$ drive signal 42 for all three LED units is set such that each LED has a current ILED of 2.1 uA. As shown in FIG. 17, when the resistance of the LED2 resistor is low (Rled=100Ω–100 kΩ and LED2 is functioning normally), the LED1 and LED3 currents are 2.1 uA and the LED2 current is high at 2 μA. Thus, LED1, LED2, and LED3 all emit light, as desired. In contrast, if the LED2 resistor is high (Rled=100 MΩ–10 GΩ and LED2 is missing or at high resistance), the LED1 and LED3 currents are each increased to 3.15 to and the LED2 current is zero. Thus, LED1 and LED3 emit additional light and LED2 does not, demonstrating that LED1 and LED3 are emitting light in place of the missing or defective LED2.

Figure 18:
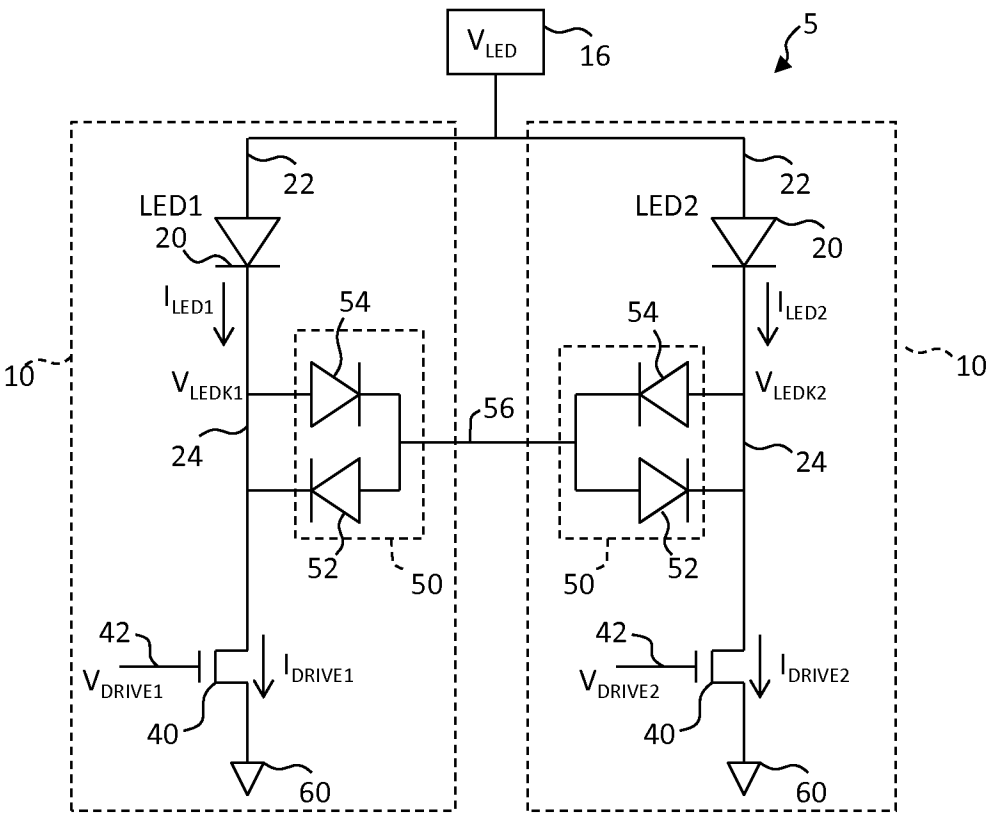
FIG. 18 is a schematic illustration of an alternative embodiment of the present invention including a common compensation connection.
Figure 19:
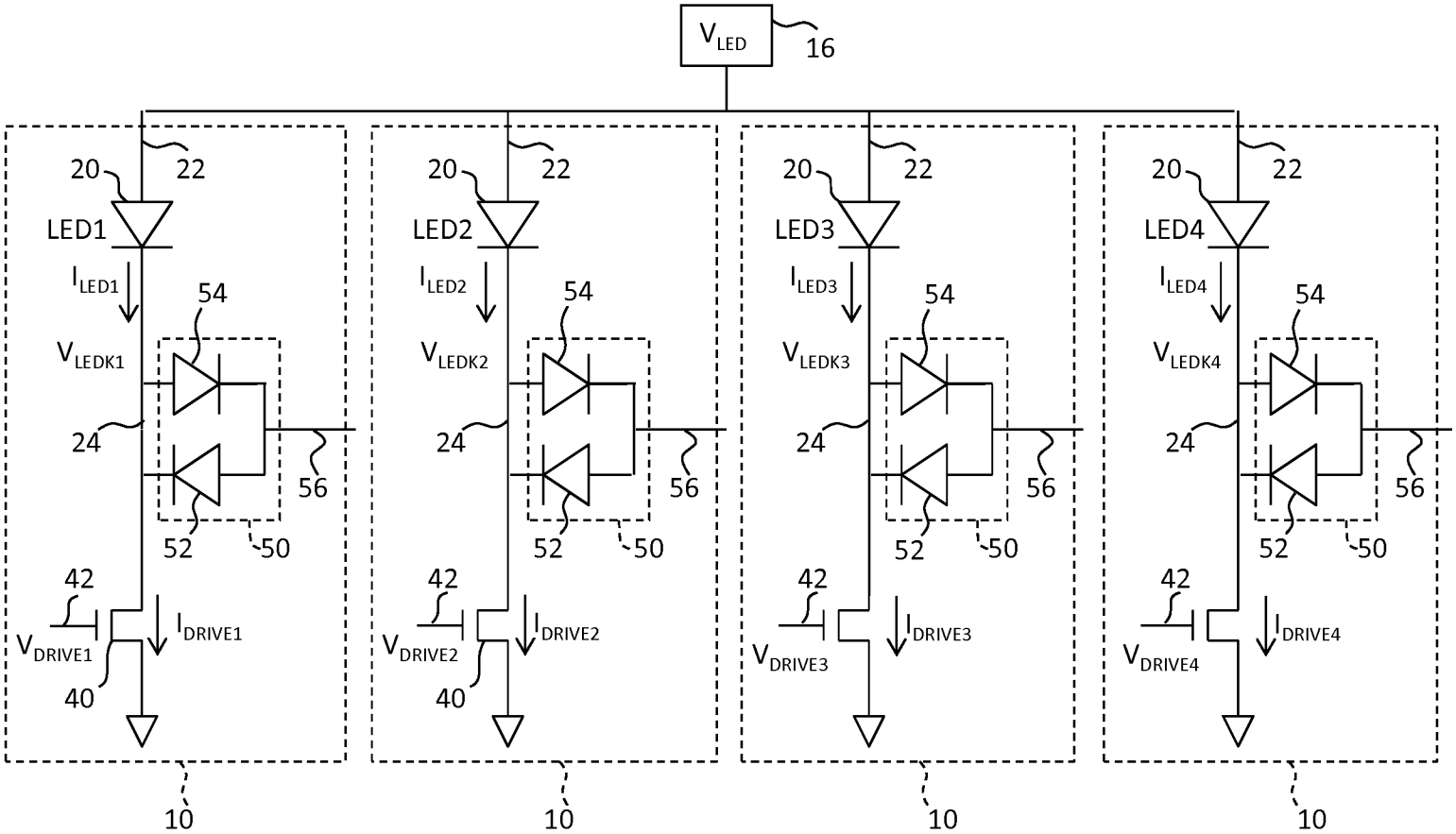
FIG. 19 is a schematic illustration of an embodiment of the present invention including four light-emitter circuits and a common compensation connection.

Referring next to the alternative embodiment illustrated in FIGS. 18 and 19, corresponding to FIGS. 1 and 4, a self-compensating circuit 5 includes a plurality of the light-emitter circuits 10, each light-emitter circuit 10 having a light emitter 20, a drive transistor 40, and a compensation circuit 50 connected as described above with respect to FIGS. 1 and 4. However, in the embodiment of FIGS. 18 and 19, the compensation circuit 50 in each light-emitter circuit 10 has only one compensation diode 52. As in FIGS. 1 and 4, the compensation diode 52 is electrically connected to the emitter connection 24.

In addition to the compensation diode 52, each compensation circuit 50 includes one transfer diode 54 connected to the emitter connection 24 and to a common compensation connection 56. The transfer diode 54 is connected with a polarity that is the reverse of the compensation diode 52 so that current passing through the transfer diode 54 of one light-emitting circuit 10 passes through the compensation diode 52 and not the transfer diode 54 of another light-emitting circuit 10. The common compensation connection 56 is connected to the compensation diode 52. Thus, each compensation diode 52 in each light-emitter circuit 10 is connected to the emitter connection 24 of one or more different light-emitter circuits 10. In the embodiment of FIGS. 1 and 4, each compensation diode 52 in each light-emitter circuit 10 is directly connected to the emitter connection 24 of one or more different light-emitter circuits 10. In contrast, in the embodiment of FIGS. 18 and 19, the each compensation diode 52 in each light-emitter circuit 10 is indirectly connected to the emitter connection 24 through the transfer diode 54 but, as intended herein, the compensation diode 52 in each light-emitter circuit 10 is connected to the emitter connection 24 of one or more different light-emitter circuits 10.

The common compensation connection 56 of each light-emitter circuit 10 is also electrically connected in common. Each and every transfer diode 54 and each and every compensation diode 52 of the compensation circuit 50 of every light-emitter circuit 10 in the self-compensating circuit 5 are electrically connected together. For clarity, in FIG. 19 the common compensation connection 56 is not explicitly shown as connected, but the wire connection of the common compensation connection 56 of each light-emitter circuit 10 is connected together in a single electrical connection.

The embodiment of FIGS. 18 and 19 has an additional voltage drop across the transfer diode 54 but has the advantage of requiring fewer diodes for self-compensating circuits 5 that have three or more light-emitter circuits 10. The embodiment also has the advantage of requiring only a single electrical connection between light-emitter circuits 10 regardless of the number of light-emitter circuits 10. In contrast, the light-emitter circuits 10 in the embodiment of FIGS. 1 and 4 each require an electrical connection from all of the other light-emitter circuits 10 in the self-compensating circuit 5. For example, in the case of FIG. 4 with four light-emitter circuits 10, each light-emitter circuit 10 has three electrical connections from other light-emitter circuits 10. Thus, the embodiment of FIGS. 18 and 19 can have fewer components and wires, simplifying and reducing the size of the self-compensating circuit 5, thereby improving yields and reducing costs.

An embodiment of the present invention was simulated to demonstrate its performance. In this simulation, a resistor Rled was placed in series with the LED2 light emitter 20 and the resistance of the resistor varied from 100Ω to 10 GΩ to simulate the effect of a functioning light emitter 20 at low resistance and a missing or defective light emitter 20 at high resistance. An additional light emitter circuit 10 was added to the circuit of FIG. 1 in which a LED LED3 and associated diodes 52 and 54 were added between the emitter connection 24 of LED3 and the emitter connection 24 of LED2.

Figure 20:
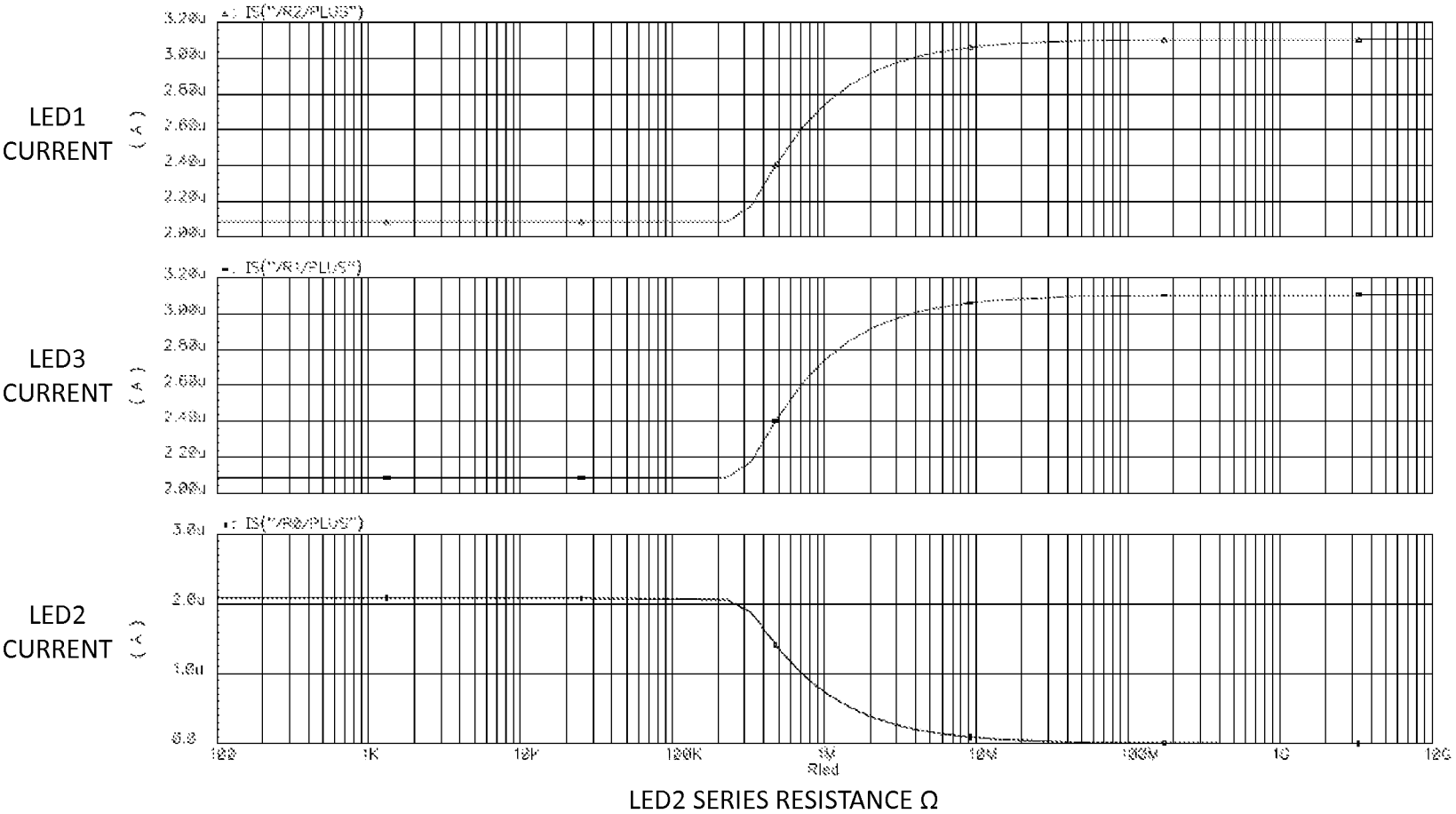
FIG. 20 is a graph illustrating the performance of an embodiment of the present invention.

FIG. 20 illustrates the simulated performance of the embodiment of FIGS. 18 and 19 having three light-emitting circuits 10. In this simulation, the $V_{DRIVE2}$ drive signal 42 for all three LED units is set such that each LED has an approximately 2 uA current. As shown in FIG. 17, when the resistance of the LED2 resistor is low (Rled=100Ω–10 kΩ and LED2 is functioning normally), the LED1 and LED3 currents remain at 2 uA and the LED2 current is high at 2 μA. Thus, LED1, LED2 and LED3 emit light, as desired. In contrast, if the LED2 resistor is high (Rled=100 MΩ–10 GΩ and LED2 is missing or at high resistance), the LED1 and LED3 currents are higher at approximately 3 to and the LED2 current is zero. Thus, LED1 and LED3 emit light and LED2 does not, demonstrating that LED1 and LED3 are emitting light in place of the missing or defective LED2.

In embodiments of the present invention, the transfer diodes 54 and compensation diodes 52 can be replaced with diode-connected transistors, Schottky diodes, or any other two-terminal device with a diode behavior; such embodiments are included in the present invention. In such an embodiment, the gate and drain of the diode-connected transistors provide a single diode connection and the source provides another diode connection. Thus, a transistor with a gate and drain connected in common is equivalent to a diode and can be used in place of a diode and such an embodiment is included in the present invention.

The relative amount of the current $I_H$ passing through each of the compensation diodes 52 is in proportion to the compensation diode 52 size since all of the compensation diodes 52 in the light-emitter circuit 10 have a common connection to the emitter connection 24 that conducts current through the common drive transistor 40. Thus, in an embodiment, the size of the compensation diodes 52 in a light-emitter circuit is selected in correspondence with the size of the drive transistor 40. Since unnecessarily large diodes are a waste of material and substrate space, it is useful to reduce the size of diodes where possible. In a useful example, the compensation diodes 52 in the light-emitter circuit 10 each have a size equal to or less than the drive transistor 40. Moreover, the size of the compensation diodes 52 in the light-emitter circuit 10 can be inversely related to the number of compensation diodes 52 so that as the number of the compensation diodes 52 increases, the size of the compensation diodes 52 decreases. In a particular embodiment, the size of the compensation diodes 52 in the light-emitter circuit 10 is approximately equal to the size of the drive transistors 40 divided by the number of the compensation diodes 52, for example within 20%, within 10%, or within 5%.

For example, the embodiment illustrated in FIG. 4 illustrates four light-emitter circuits 10 each having three compensation diodes 52. In an embodiment, each of the compensation diodes 52 is one third of the size of the drive transistors 40. Thus, when an identical drive signal 42 is applied to each of the drive transistors 40 of the four light-emitter circuits 10, if LED1, LED2, LED3, and LED4 are all functioning properly they will each emit the same amount of light (assuming they are the same type and size of LED). If one of the LEDs if faulty, the other three LEDs will each emit an increased amount of light, as discussed above. Since the total amount of current $I_H$ passing through the compensation diodes 52 is desirably the same amount of current $I_{DRIVE}$ that would pass through the LED if it was not faulty, the total size of the compensation diodes 52 together is usefully the same as the drive transistor 40 and therefore the size of each of the three individual compensation diodes 52 is one third the size of the drive transistors 40.

Figure 8:
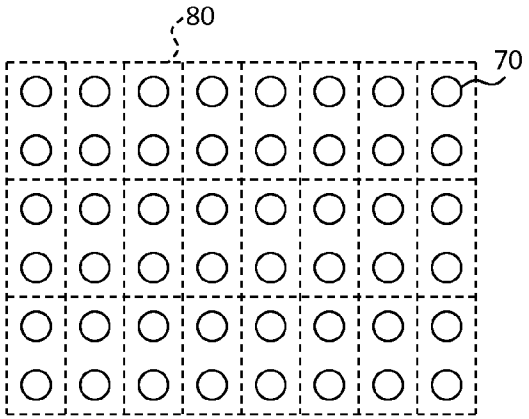
FIGS. 7-9 are schematic illustrations of pixel groups arranged in accordance with an embodiment of the present invention.
Figure 7:
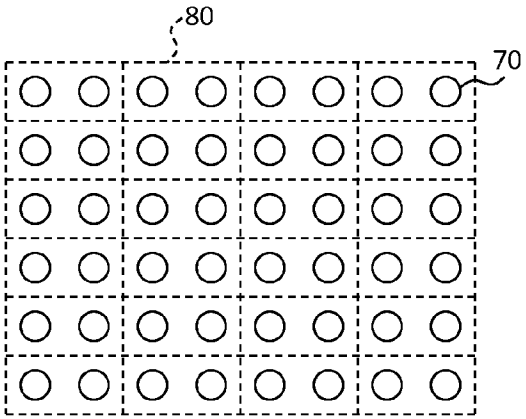
Figure 9:
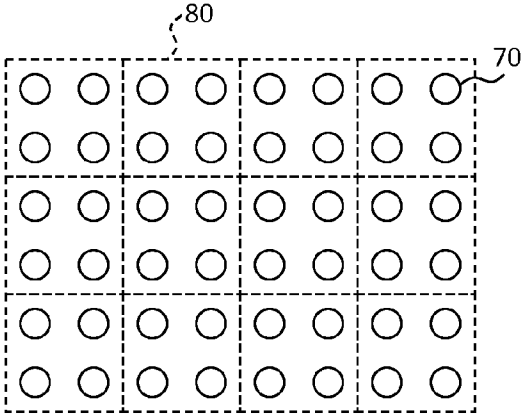

As shown in FIG. 6, the self-compensating display 4 of the present invention can include an array of pixels 70 forming rows and columns of pixels 70 on a display substrate 6. Each pixel 70 is controlled by the self-compensating circuit 5 (FIG. 1). As shown in FIG. 7, the pixels 70 are arranged in groups 80. In one embodiment and as shown in FIGS. 7-9, the pixels 70 are arranged in exclusive groups 80 of spatially adjacent pixels 70. Spatially adjacent pixels 70 are pixels 70 that have no other pixel 70 between the spatially adjacent pixels 70. In an exclusive group 80 of pixels 70, each pixel 70 in the group 80 is included in only one group 80 so that no pixel 70 is in more than one group 80. The pixels 70 (corresponding to a light emitter 20) in each group 80 can be part of a common self-compensating circuit 5 and each pixel 70 is included in a different light-emitter circuit 10. In such an embodiment, each compensation diode 52 in the light-emitter circuit 10 is connected to a different one of the emitter connections 24 in the light-emitter circuits 10 of each pixel 70 in the exclusive group 80. Thus, the number of compensation diodes 52 in each light-emitter circuit 10 is equal to one less than the number of pixels 70 in the exclusive group 80 (as shown in FIGS. 1 and 4).

Furthermore, in a useful embodiment and as illustrated in FIGS. 7-9, the pixels 70 in an exclusive group 80 are spatially adjacent in the array. As shown in FIGS. 7 and 8, each exclusive group 80 includes only two pixels 70. The two pixels 70 in each exclusive group 80 in FIG. 7 are spatially adjacent in different columns. The two pixels 70 in each exclusive group 80 in FIG. 8 are spatially adjacent in different rows. In both of the examples of FIGS. 7 and 8, if either of the pixels 70 in any exclusive group 80 fails, the other of the pixels 70 in the exclusive group 80 will emit additional light in compensation.

Referring to FIG. 9, each exclusive group 80 includes only four spatially adjacent pixels 70. The four pixels 70 are arranged in a two-by-two array forming two rows and two columns. In this embodiment, if any of the four pixels 70 in an exclusive group 80 fails, the other of the pixels 70 in the exclusive group 80 will emit additional light in compensation. The arrangement of FIG. 9 can correspond to the self-compensating circuit 5 of FIG. 4.

In the embodiment of FIG. 7, for example, if a pixel 70 spatially on the left side of the pixel pair making up an exclusive group 80 fails, the pixel 70 spatially on the right side of the pixel pair will compensate. Similarly, if the pixel 70 spatially on the right side of the pixel pair making up an exclusive group 80 fails, the pixel 70 spatially on the left side of the pixel pair will compensate. In an alternative embodiment, if a pixel 70 fails, a pixel 70 with a location specified with respect to the failed pixel 70 will compensate, for example the pixel 70 always to the left (ignoring the edges of the pixel array). Such an embodiment employs non-exclusive, overlapping groups 80 of spatially adjacent pixels 70.

Figure 10B:
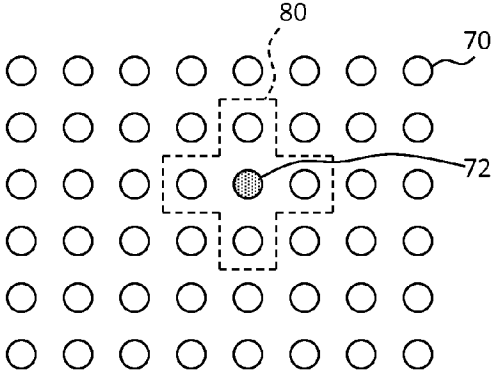
FIGS. 10A-10D are illustrations of overlapping pixel groups arranged in accordance with embodiments of the present invention.
Figure 10D:
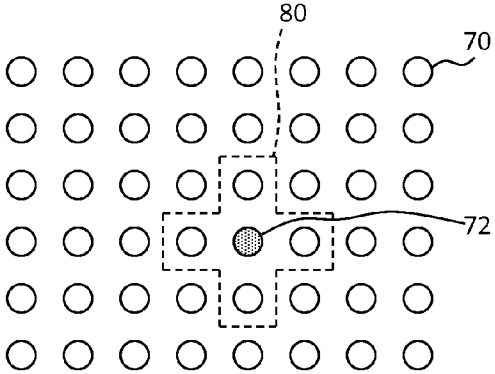
Figure 10A:
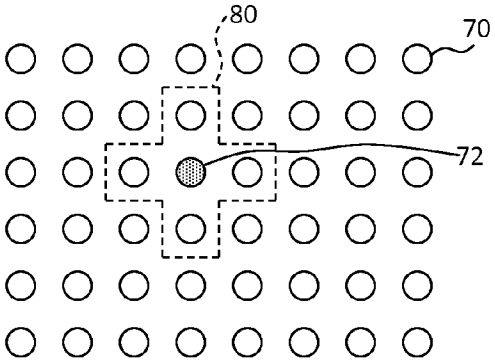
Figure 10C:
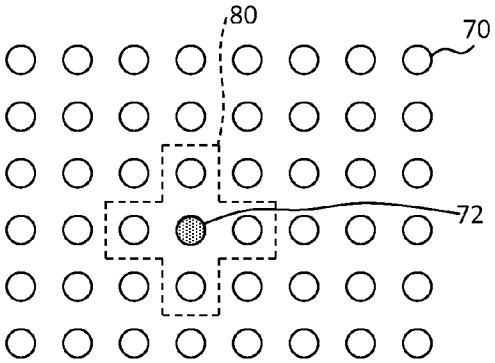

FIGS. 10A-10D illustrate a common array of pixels 70 arranged in non-exclusive groups 80 of five spatially adjacent pixels 70 forming a "+" symbol including a central pixel 72, a left pixel 70 to the left of the central pixel 72, a right pixel 70 to the right of the central pixel 72, an upper pixel 70 above the central pixel 72, and a lower pixel 70 below central pixel 72. The group 80 of pixels 70 is shown with the central pixel 72 located at (x, y) coordinate (4, 3) in FIG. 10A. If the central pixel 72 fails, the left, right, upper, and lower pixels 70 in the group 80 will emit additional light to compensate for the failure of the central pixel 72. This is accomplished by connecting the emitter connections 24 of the left, right, upper, and lower pixels 70 to the sources of the compensation diodes 52 of FIG. 10A. However, if the right pixel 70 failed, because group 80 of FIG. 10A is not an exclusive group 80, the central, left, upper, and lower pixels 70 would not compensate. Instead, referring to FIG. 10B, the right pixel 70 of FIG. 10A (at location 5, 3) is the central pixel 72 as shown in FIG. 10B and the pixels 70 of the group 80 indicated in FIG. 10B would compensate. The groups 80 of FIGS. 10A and 10B overlap because the central pixel 72 and right pixel 70 of FIG. 10A are also found in the group 80 of FIG. 10B as the left pixel 70 and the central pixel 72. Similarly, if the bottom pixel 70 of FIG. 10A failed, the group 80 of pixels 70 found in FIG. 10C would provide compensation. In the example of FIG. 10D, the upper and left pixels 70 of the group 80 correspond to the right and lower pixels 70 of FIG. 10A. Forming the overlapping groups 80 of FIGS. 10A-10D is simply a matter of connecting the emitter connections 24 of the non-central pixels 70 in each group 80 to the compensation diodes 52 of the central pixel 72. Such a non-exclusive group structure provides a more consistent compensation scheme across the array of pixels 70.

Figure 11:
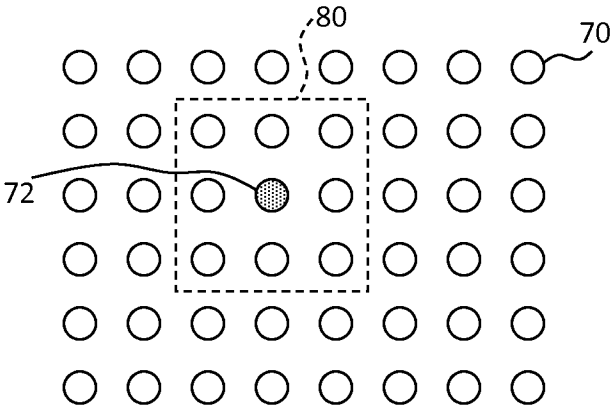
FIG. 11 is an illustration of a pixel group arranged in accordance with embodiments of the present invention.

Referring to FIG. 11, a group 80 of adjacent pixels 70 is arranged in a three-by-three matrix of three rows and three columns with the central pixel 72 having a pixel 70 above, a pixel 70 below, a pixel 70 on the left side, a pixel 70 on the right side, a pixel 70 on the upper left, a pixel 70 on the upper right, a pixel 70 on the lower left, and a pixel 70 on the lower right. Such a group 80 can be exclusive or non-exclusive, depending on the electrical connection of the emitter connection 24 and the compensation diodes 52.

In an embodiment of the present invention, the self-compensating control circuits 5 are formed in a thin-film of silicon formed on the display substrate 6. Such structures and methods for manufacturing them are well known in the thin-film display industry. In an alternative embodiment illustrated in FIG. 12, the light emitters 20 are formed in a separate substrate, for example a crystalline silicon substrate, and applied to a display substrate surface 7 of the display substrate 6, for example by micro-transfer printing. For a discussion of micro-transfer printing techniques see U.S. Pat. Nos. 8,722,458, 7,622,367 and 8,506,867, each of which is hereby incorporated by reference.

Similarly, the supporting electronic circuit components of the light-emitter circuits 10 excluding the light emitters 20 can be constructed in or on a substrate separate from the display substrate 6 or the light emitters 20 as a light-emitter control circuit 11 and transferred to the display substrate 6. Each group 80 of light emitters 20 controlled by a common light-emitter control circuit 11 forms a pixel element 74 and spatially adjacent pixel elements 74 can form groups 80. Alternatively, the group 80 of light emitters 20 controlled by a common light-emitter control circuit 11 and forming the pixel element 74 can also define a group 80 (not shown). Wire interconnections are omitted from FIG. 12 for illustration clarity. As noted above, the pixels 70 of a group 80 can correspond to the light emitters 20 of the self-compensating circuit 5 of the present invention so that the pixels 70 of the group 80 mutually compensate for any defective pixels 70. The pixel elements 74 can include light emitters 20 emitting light of different colors or of the same color.

Figure 12:
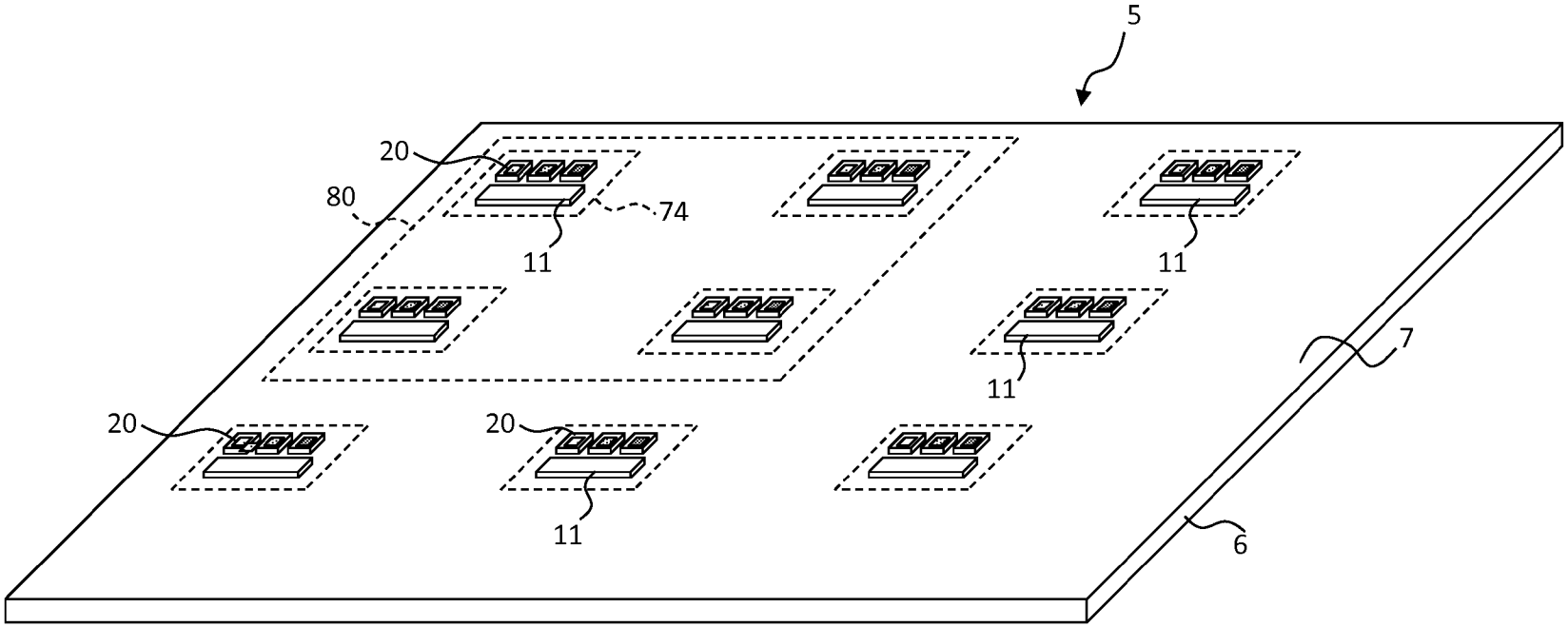
FIG. 12 is a perspective of an embodiment of the present invention.
Figure 13:
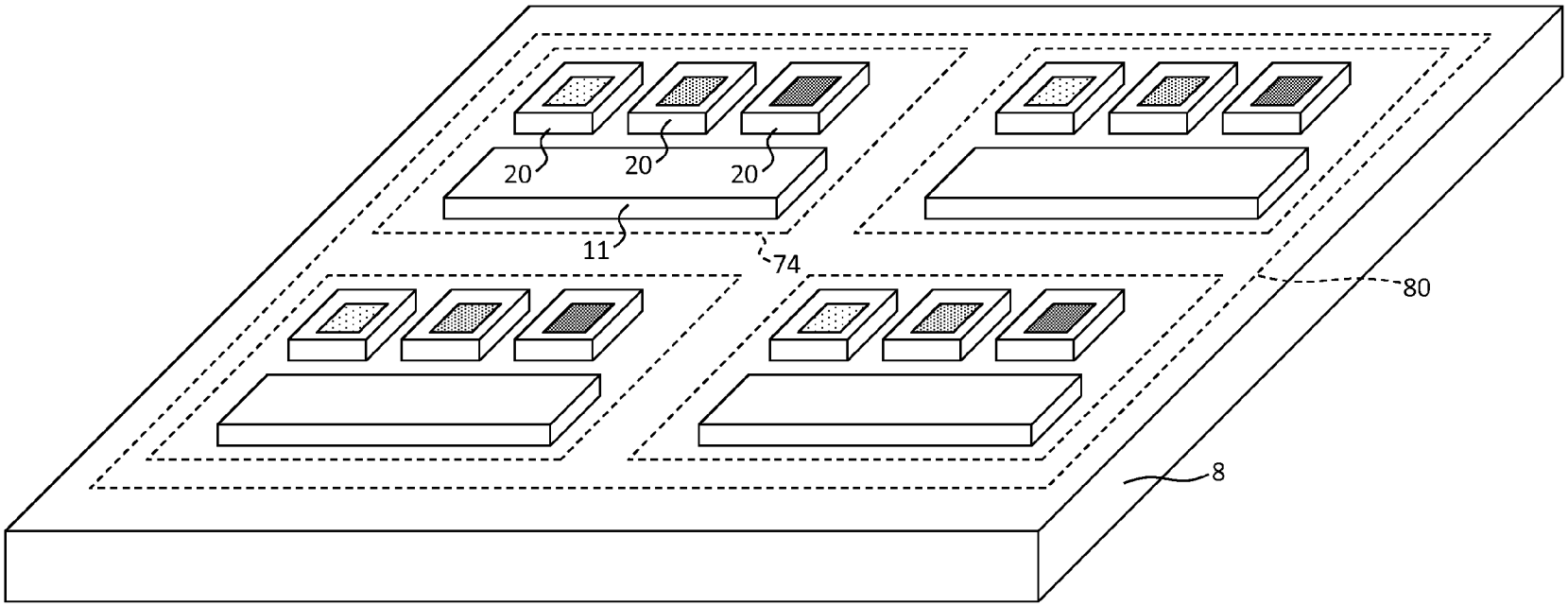
FIG. 13 is a perspective of a pixel element in accordance with an embodiment of the present invention.
Figure 14:
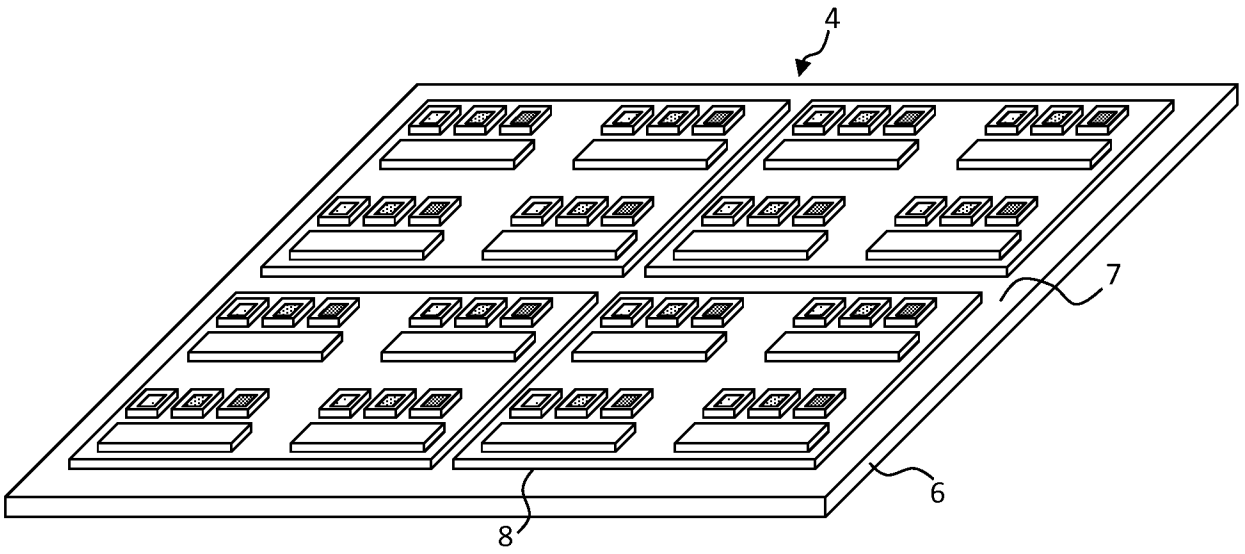
FIG. 14 is a perspective of an embodiment of the present invention.

Referring to FIG. 13, in another embodiment of the present invention, pixels 70 in a group 80, for example an exclusive group 80, including the light emitters 20 and the light-emitter control circuit 11 forming the pixel elements 74 are located on a pixel substrate 8 that is independent and separate from the display substrate 6 (FIG. 12) and then optionally interconnected using photolithographic methods and tested. The pixel substrates 8 are mounted on the display substrate surface 7 of the display substrate 6, as shown in FIG. 14. The light-emitter circuits 10 (FIG. 1) on the pixel substrates 8 are then interconnected, for example using photolithographic methods. A further discussion of utilizing pixel substrates in a display can be found in commonly assigned U.S. Patent Application No. 62/055,472 filed Sep. 25, 2014, entitled Compound Micro-Assembly Strategies and Devices, the contents of which are incorporated by reference herein in its entirety.

The self-compensating circuit 5 of the present invention can be constructed using circuit design tools and integrated circuit manufacturing methods known in the art. LEDs and micro-LEDs are also known, as are circuit layout and construction methods. The self-compensating displays 4 of the present invention can be constructed using display and thin-film manufacturing method independently of or in combination with micro-transfer printing methods, for example as are taught in U.S. patent application Ser. No. 14/743,981, filed Jun. 18, 2015, entitled Micro-Assembled Micro LED Displays and Lighting Elements, the contents of which are hereby incorporated by reference.

Figure 15:
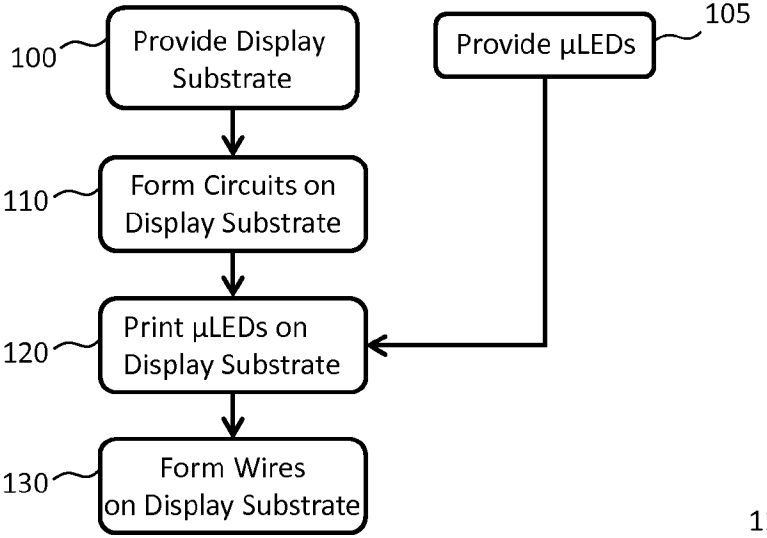

Referring also to FIG. 15 and also to FIG. 12, in a method of the present invention the display substrate 6 is provided in step 100. The display substrate 6 can be any conventional substrate such as glass, plastic, or metal or include such materials. The display substrate 6 can be transparent, for example having a transmissivity greater than or equal to 50%, 80%, 90%, or 95% for visible light. The display substrate 6 usefully has two opposing smooth sides (such as the display substrate surface 7) suitable for material deposition, photolithographic processing, or micro-transfer printing of micro-LEDs. The display substrate 6 can have a size of a conventional display, for example a rectangle with a diagonal length of a few centimeters to one or more meters and a thickness of 0.1 mm, 0.5 mm, 1 mm, 5 mm, 10 mm, or 20 mm. Such substrates are commercially available. Before, after, or at the same time the display substrate 6 is provided in step 100, the light emitters 20 (e.g. micro-LEDs) are provided in step 105, using conventional photolithographic integrated-circuit processes on semiconductor substrates. The micro-LED semiconductor substrates are much smaller than and separate and distinct from the display substrate 6 and can include different materials. In an alternative method, the light-emitter circuit 10 is made in a semiconductor coating formed on the display substrate 6 using conventional substrate processing methods, for example employing low- or high-temperature polysilicon processed, for example with excimer lasers, to form localized crystalline silicon crystals (e.g. LTPS) as is known in the display art. Methods, tools, and materials for making LEDs are well known in the lighting and LCD backlight industries.

In step 110 conductive wires, for example electrical interconnections, are formed on the display substrate 6 using conventional photolithographic and display substrate processing techniques known in the art, for example photolithographic processes employing metal or metal oxide deposition using evaporation or sputtering, curable resin coatings (e.g. SU8), positive or negative photo-resist coating, radiation (e.g. ultraviolet radiation) exposure through a patterned mask, and etching methods to form patterned metal structures, vias, insulating layers, and electrical interconnections Inkjet and screen-printing deposition processes and materials can be used to form the patterned conductive wires or other electrical elements.

In an embodiment, the light emitters 20 (e.g. micro-LEDs) formed in step 105 are transfer printed to the display substrate 6 in step 120 in one or more transfers. The light-emitter control circuits 11 can also be formed in a separate substrate such as a crystalline semiconductor substrate and transferred to the display substrate 6. Micro-transfer printing methods are known in the art and are referenced above. The transferred light emitters 20 are then interconnected in step 130 using similar materials and methods as in step 110, for example with the conductive wires and optionally including connection pads and other electrical connection structures known in the art, to enable a display controller to electrically interact with the light emitters 20 to emit light in the self-compensating display 4. In alternative processes, the transfer or construction of the light emitters 20 is done before or after all of the conductive wires are in place. Thus, in embodiments the construction of the conductive wires can be done before the light emitters 20 light-emitter control circuits 11 are printed (in step 110 and omitting step 130) or after the light emitters 20 are printed (in step 130 and omitting step 110), or using both steps 110 and 130. In any of these cases, the light emitters 20 and the light-emitter control circuits 11 are electrically connected with the conductive wires, for example through connection pads on the top or bottom of the light emitters 20.

Figure 16:
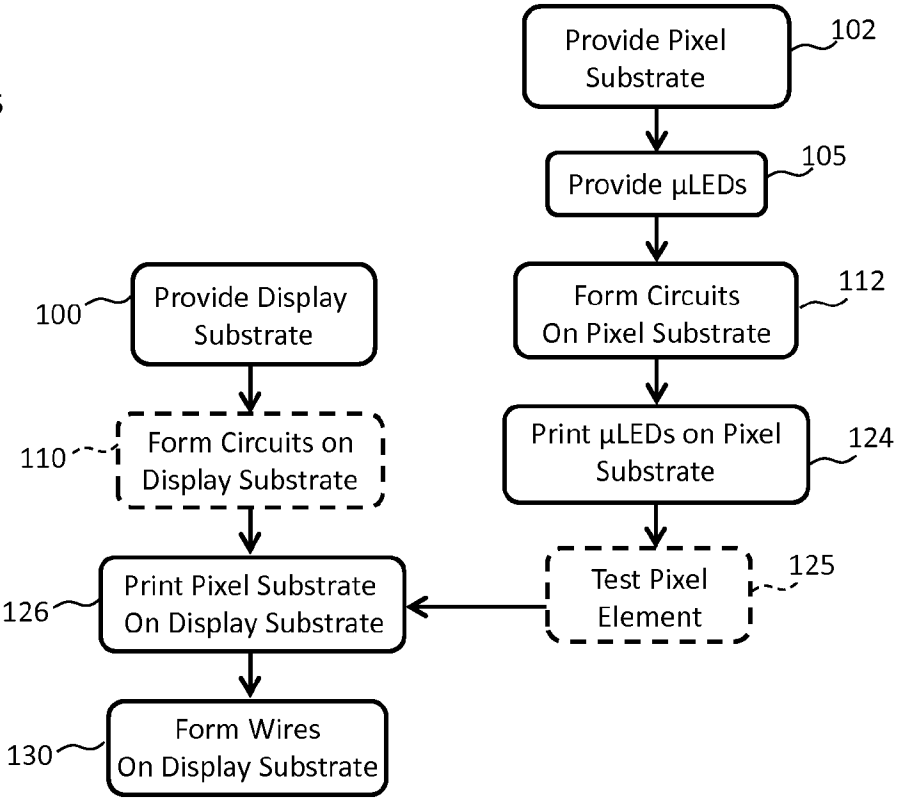
FIGS. 15-16 are flow charts illustrating methods of the present invention.

Referring next to FIG. 16, in yet another process and referring also to FIGS. 13 and 14, the pixel substrate 8 is provided in step 102 in addition to providing the display substrate 6 (in step 100), providing the light emitters 20 (in step 105), and providing the light-emitter control circuit 11. The pixel substrate 8 can, for example, be similar to the display substrate 6 (e.g. made of glass or plastic) but in a much smaller size, for example having an area of 50 square microns, 100 square microns, 500 square microns, or 1 square mm and can be only a few microns thick, for example 5 microns, 10 microns, 20 microns, or 50 microns. Any desired circuits or wiring patterns are formed on the pixel substrate 8 in step 112. Alternatively, circuitry and wiring are formed on the pixel substrate 8 after the light emitters 20 and the light-emitter control circuit 11 are provided on the pixel substrate 8 in the following step. The light emitters 20 (e.g. micro-LEDs) and the light-emitter control circuit 11 are transfer printed onto the pixel substrate 8 in step 124 using one or more transfers from one or more semiconductor wafers to form the pixel element 74 with the pixel substrate 8 separate from the display substrate 6, the substrate of the light-emitter control circuit 11, and the substrates of the light emitters 20. In an alternative embodiment, not shown, the pixel substrate 8 includes a semiconductor and the light emitters 20 and the light-emitter control circuit 11 and, optionally, some electrical interconnections, are formed in the pixel substrate 8. In optional step 142, electrical interconnects are formed on the pixel substrate 8 to electrically interconnect the light emitters 20 and the light-emitter control circuit 11, for example using the same processes that are employed in steps 110 or 130. In optional step 125, the pixel elements 74 on the pixel substrates 8 are tested and accepted, repaired, or discarded. In step 126, the pixel elements 74 are transfer printed or otherwise assembled onto the display substrate 6 and then electrically interconnected in step 130 with the conductive wires and to connection pads for connection to a display controller. The steps 102 and 105 can be done in any order and before or after any of the steps 100 or 110.

By employing the multi-step transfer or assembly process of FIG. 15, increased yields are achieved and thus reduced costs for the self-compensating display 4 of the present invention.

As is understood by those skilled in the art, the terms "over" and "under" are relative terms and can be interchanged in reference to different orientations of the layers, elements, and substrates included in the present invention. For example, a first layer on a second layer, in some implementations means a first layer directly on and in contact with a second layer. In other implementations a first layer on a second layer includes a first layer and a second layer with another layer there between.

Having described certain implementations of embodiments, it will now become apparent to one of skill in the art that other implementations incorporating the concepts of the disclosure may be used. Therefore, the invention should not be limited to the described embodiment, but rather should be limited only by the spirit and scope of the following claims.

Throughout the description, where apparatus and systems are described as having, including, or comprising specific components, or where processes and methods are described as having, including, or comprising specific steps, it is contemplated that, additionally, there are apparatus, and systems of the disclosed technology that consist essentially of, or consist of, the recited components, and that there are processes and methods according to the disclosed technology that consist essentially of, or consist of, the recited processing steps.

It should be understood that the order of steps or order for performing certain action is immaterial so long as the disclosed technology remains operable. Moreover, two or more steps or actions in some circumstances can be conducted simultaneously. The invention has been described in detail with particular reference to certain embodiments thereof, but it will be understood that variations and modifications can be effected within the spirit and scope of the invention.

PARTS LIST

4 self-compensating display
5 self-compensating circuit
6 display substrate
7 display substrate surface
8 pixel substrate
10 light-emitter circuit
11 light-emitter control circuit
16 power supply
20 light emitter
22 power connection
24 emitter connection
40 drive transistor
42 drive signal

50 compensation circuit
52 compensation diode
54 transfer diode
56 common compensation connection
60 ground
70 pixel
72 central pixel
74 pixel element
80 group of pixels
90 diode
91 first diode connection
92 second diode connection
100 provide display substrate step
102 provide pixel substrate step
105 provide light emitters step
110 form circuits on display substrate step
112 form circuits on pixel substrate step
120 print micro-LEDs on display substrate step
124 print micro-LEDs on pixel substrate step
125 optional test pixel element step
126 print pixel substrate on display substrate step
130 form wires on display substrate step

The invention claimed is:

1. A self-compensating circuit for controlling pixels in a display, comprising:

a plurality of light-emitter circuits, each light-emitter circuit comprising:

a light emitter having a power connection to a power supply and an emitter connection;

a drive transistor having a gate connected to a drive signal, a drain connected to the emitter connection, and a source connected to a ground; and a compensation circuit comprising one or more compensation diodes, each compensation diode directly connected to the emitter connection and directly connected to an other emitter connection of one or more light-emitter circuits other than the light-emitter circuit of which the compensation diode is a part, thereby emitting compensatory light from the one or more light-emitter circuits when the light emitter is faulty.

2. The self-compensating circuit of claim 1, wherein the light emitters are inorganic light-emitters.

3. The self-compensating circuit of claim 2, wherein the inorganic light emitters are inorganic light-emitting diodes.

4. The self-compensating circuit of claim 1, wherein the size of the compensation diodes in a light-emitter circuit is inversely related to the number of compensation diodes in the light-emitter circuit.

5. The self-compensating circuit of claim 1, wherein each compensation circuit of the plurality of light-emitter circuits has one compensation diode and the compensation diode is electrically connected in common to a common compensation connection and wherein each compensation circuit further comprises a transfer diode connected to the emitter connection and to the common compensation connection with a polarity that is the reverse of the compensation diode polarity.

6. A self-compensating display, comprising an array of light emitters forming rows and columns of light emitters on a display substrate, each light emitter controlled by the self-compensating circuit of claim 1.

7. The display of claim 6, wherein the display substrate is a polymer, plastic, resin, polyimide, PEN, PET, metal, metal foil, glass, a semiconductor, or sapphire.

8. The self-compensating display of claim 6, wherein the light emitters are arranged in exclusive groups of adjacent light emitters so that each light emitter is a member of only one group and wherein each compensation diode in a light-emitter circuit of a light emitter is connected to a different one of the emitter connections in the light-emitter circuits of the other light emitters in the exclusive group of which the light emitter is a member.

9. The self-compensating display of claim 8, wherein the number of compensation diodes in each light-emitter circuit is equal to one less than the number of light emitters in the exclusive group of which the light emitters are members.

10. The self-compensating display of claim 6, wherein each group of adjacent light emitters comprises two light emitters located in adjacent rows.

11. The self-compensating display of claim 6, wherein each group of adjacent light emitters comprises two light emitters located in adjacent columns.

12. The self-compensating display of claim 6, wherein each group of adjacent light emitters comprises four light emitters located in a two by two array forming two rows and two columns.

13. The self-compensating display of claim 6, wherein each group of adjacent light emitters is located on a pixel substrate that is independent and separate from the display substrate and the pixel substrates are mounted on the display substrate.

14. The self-compensating display of claim 6, wherein each light emitter is located on a pixel substrate that is independent and separate from the display substrate and the pixel substrates are mounted on the display substrate.

15. The self-compensating display of claim 6, wherein the light emitters are arranged in groups of adjacent light emitters and wherein each compensation diode in each light-emitter circuit is connected to a different one of the emitter connections in the light-emitter circuits of each light emitter in the group.

16. The self-compensating display of claim 15, wherein at least one group of light emitters overlaps another group of light emitters so that at least one light emitter is a member of more than one group.

17. The self-compensating display of claim 16, wherein each group of adjacent light emitters comprises five light emitters, the five light emitters arranged with a central light emitter having a left light emitter to the left of the central light emitter, a right light emitter to the right of the central light emitter, an upper light emitter above the central light emitter, and a lower light emitter below the central light emitter.

18. A self-compensating circuit for controlling pixels in a display, comprising:

a plurality of light-emitter circuits, each light-emitter circuit comprising:

a light emitter having a power connection to a power supply and an emitter connection;

a drive transistor having a gate connected to a drive signal, a drain connected to the emitter connection, and a source connected to a ground; and one or more compensation diodes, each compensation diode directly connected to the emitter connection of the light-emitter circuit of which the one or more compensation diodes are a part;

wherein the number of compensation diodes in each light-emitter circuit is one fewer than the number of light emitters in the self-compensating circuit and each compensation diode in each light-emitter circuit is directly connected to an other emitter connection of each of one or more light-emitter circuits other than the light-emitter circuit of which the compensation diode is a part, thereby emitting compensatory light from the one or more light-emitter circuits when the light emitter is faulty.

* * * * *